US007290853B2

(12) United States Patent
Silverbrook

(10) Patent No.: US 7,290,853 B2
(45) Date of Patent: Nov. 6, 2007

(54) INKJET PRINTHEAD WITH A TWO DIMENSIONAL ARRAY OF INK EJECTION NOZZLE ARRANGEMENTS

(75) Inventor: Kia Silverbrook, Balmain (AU)

(73) Assignee: Silverbrook Research Pty Ltd, Balmain, New South Wales (AU)

( * ) Notice: Subject to any disclaimer, the term of this patent is extended or adjusted under 35 U.S.C. 154(b) by 0 days.

(21) Appl. No.: 11/730,408

(22) Filed: Apr. 2, 2007

(65) Prior Publication Data

US 2007/0171256 A1 Jul. 26, 2007

Related U.S. Application Data

(63) Continuation of application No. 11/472,402, filed on Jun. 22, 2006, now Pat. No. 7,207,658, which is a continuation of application No. 11/188,018, filed on Jul. 25, 2005, now Pat. No. 7,229,153, which is a continuation of application No. 11/013,461, filed on Dec. 17, 2004, now Pat. No. 6,959,983, which is a continuation of application No. 10/667,175, filed on Sep. 22, 2003, now Pat. No. 6,860,107, which is a continuation-in-part of application No. 09/504,221, filed on Feb. 15, 2000, now Pat. No. 6,612,110.

(30) Foreign Application Priority Data

Feb. 15, 1999 (AU) ..... PP8688

(51) Int. Cl.
*B41J 2/145* (2006.01)
*B41J 2/155* (2006.01)
*B41J 2/04* (2006.01)

(52) U.S. Cl. ..... 347/40; 347/42; 347/54

(58) Field of Classification Search ..... 347/40, 347/42, 44, 54, 56, 62–65, 67; 60/527–529
See application file for complete search history.

(56) References Cited

U.S. PATENT DOCUMENTS

| | | | | |
|---|---|---|---|---|
| 3,842,382 A | | 10/1974 | Bell | 337/107 |
| 3,968,692 A | | 7/1976 | Blattler et al. | 60/527 |
| 4,586,335 A | | 5/1986 | Hosoda et al. | 60/528 |
| 4,746,935 A | * | 5/1988 | Allen | 347/65 |
| 4,759,189 A | | 7/1988 | Stropkay et al. | 60/531 |
| 5,058,856 A | | 10/1991 | Gordon et al. | 251/11 |
| 5,263,644 A | | 11/1993 | Chen et al. | 60/527 |
| 5,994,638 A | | 11/1999 | Edelson | 136/205 |
| 6,008,776 A | | 12/1999 | Yarbrough et al. | 348/853 |
| 6,019,457 A | * | 2/2000 | Silverbrook | 347/65 |

(Continued)

FOREIGN PATENT DOCUMENTS

EP 412221 A 2/1991

(Continued)

*Primary Examiner*—Juanita D. Stephens

(57) ABSTRACT

A printhead is provided for an inkjet printer. The printhead includes a wafer substrate assembly defining a plurality of spaced apart groups of ink inlet channels. Groups of ink ejection nozzle arrangements extend from the wafer substrate assembly and are in fluid communication with respective ink inlet channel groups. Each group of ink ejection nozzle arrangements include a two dimensional array of ink ejection nozzle arrangements arranged in rows and ranks so that the rows and ranks are obliquely aligned with respect to each other.

7 Claims, 28 Drawing Sheets

U.S. PATENT DOCUMENTS

| | | | | |
|---|---|---|---|---|
| 6,364,453 | B1 | 4/2002 | Silverbrook | 347/44 |
| 6,438,954 | B1 | 8/2002 | Goetz et al. | 60/527 |
| 6,439,693 | B1 | 8/2002 | Silverbrook | 347/54 |
| 6,612,110 | B1 | 9/2003 | Silverbrook | 60/528 |
| 6,860,107 | B2 | 3/2005 | Silverbrook | 60/527 |

FOREIGN PATENT DOCUMENTS

| | | |
|---|---|---|
| EP | 0512521 A | 11/1992 |
| WO | WO 99/03681 A | 1/1999 |
| WO | WO 00/64804 | 11/2000 |

* cited by examiner

INKJET PRINTHEAD WITH A TWO DIMENSIONAL ARRAY OF INK EJECTION NOZZLE ARRANGEMENTS

CROSS REFERENCE TO RELATED APPLICATION

This is a Continuation Application of U.S. application Ser. No. 11/472,402 filed on Jun. 22, 2006, now U.S. Pat. No. 7,207,658 which is a Continuation Application of U.S. application Ser. No. 11/188,018 filed on Jul. 25, 2005, now U.S. Pat. No. 7,229,153 which is a Continuation Application of U.S. application Ser. No. 11/013,461 filed on Dec. 17, 2004, now issued U.S. Pat. No. 6,959,983, which is a Continuation of U.S. application Ser. No. 10/667,175 filed on Sep. 22, 2003, now issued U.S. Pat. No. 6,860,107, which is a Continuation-In-Part of U.S. application Ser. No. 09/504,221 filed on Feb. 15, 2000, now issued U.S. Pat. No. 6,612,110, the entire contents of which are herein incorporated by reference.

FIELD OF THE INVENTION

The present invention relates to an integrated circuit device. In particular, this invention relates to an integrated circuit device having electrothermal actuators. The invention has broad applications to such devices as micro-electromechanical pumps and micro-electromechanical movers.

BACKGROUND OF THE INVENTION

Micro-electromechanical devices are becoming increasingly popular and normally involve the creation of devices on the micron scale utilizing semi-conductor fabrication techniques. For a review on micro-electromechanical devices, reference is made to the article "The Broad Sweep of Integrated Micro Systems" by S. Tom Picraux and Paul J. McWhorter published December 1998 in IEEE Spectrum at pages 24 to 33.

One form of micro-electromechanical device is an ink jet printing device in which ink is ejected from an ink ejection nozzle chamber.

Many different techniques on ink jet printing and associated devices have been invented. For a survey of the field, reference is made to an article by J Moore, "Non-Impact Printing: Introduction and Historical Perspective", Output Hard Copy Devices, Editors R Dubeck and S Sherr, pages 207 to 220 (1988).

Recently, a new form of ink jet printing has been developed by the present applicant that uses micro-electromechanical technology. In one form, ink is ejected from an ink ejection nozzle chamber utilizing an electromechanical actuator connected to a paddle or plunger which moves towards the ejection nozzle of the chamber for ejection of drops of ink from the ejection nozzle chamber.

The present invention concerns, but is not limited to, an integrated circuit device that incorporates improvements to an electromechanical bend actuator for use with the technology developed by the Applicant.

Definitions

In this specification, the phrase "electrothermal actuator" is to be understood as an actuator that is capable of displacement upon heating. Such actuators generally use differential thermal expansion to generate movement. For example, such an actuator may incorporate a heating circuit that is positioned such that heating and subsequent expansion of the heating circuit and a region about the heating circuit results in deformation of the actuator. If the actuator is anchored to a substrate, the deformation results in movement of the actuator. The movement is harnessed to perform work.

SUMMARY OF THE INVENTION

According to a first aspect of the invention, there is provided an integrated circuit device which comprises

- a substrate;
- drive circuitry arranged on the substrate; and
- a plurality of micro-electromechanical devices positioned on the substrate, each device comprising:
  - an elongate electrothermal actuator having a fixed end that is fast with the substrate so that the actuator is connected to the drive circuitry and a free end that is displaceable along a path relative to the substrate to perform work when the actuator receives an electrical signal from the drive circuitry, wherein
  - a heat sink is positioned intermediate ends of the actuator to disperse excessive heat build-up in the actuator.

The actuator may include a pair of elongate arms that are spaced relative to each other along the path and are connected to each other at each end, with one of the arms being connected to the drive circuitry to define a heating circuit and being of a material that is capable of expansion when heated, such that, when the heating circuit receives the electrical signal from the drive circuitry, that arm expands relative to the other to deform the actuator and thus displace said free end along said path.

The heat sink may be positioned on the arm that defines the heating circuit.

Each micro-electromechanical device may include a fluid ejection member that is positioned on the free end of the actuator, the integrated circuit device including a plurality of fluid chambers positioned on the substrate, with the substrate defining fluid flow paths that communicate with the fluid chambers, each fluid ejection member being positioned in a respective fluid chamber to eject fluid from the fluid chamber on displacement of the actuator.

A sidewall and a roof wall may define each fluid chamber. The roof wall may define an ejection port. The fluid ejection member may be displaceable towards and away from the ejection port to eject fluid from the ejection port.

Each fluid ejection member may be in the form of a paddle member that spans a region between the respective fluid chamber and the respective fluid flow path so that, when the heating circuit receives a signal from the drive circuitry, the paddle member is driven towards the fluid ejection port and fluid is drawn into the respective fluid chamber.

Each paddle member may have a projecting formation positioned on a periphery of the paddle member. The formation may project towards the ejection port so that the efficacy of the paddle member can be maintained while inhibiting contact between the paddle member and a meniscus forming across the ejection port.

Each actuator may include at least one strut that is fast with each arm at a position intermediate ends of the arms.

According to a second aspect of the invention, there is provided a mechanical actuator for micro mechanical or micro electromechanical devices, the actuator comprising:

- a supporting substrate;
- an actuation portion;

a first arm attached at a first end thereof to the substrate and at a second end to the actuation portion, the first arm being arranged, in use, to be conductively heated;

a second arm attached at a first end to the supporting substrate and at a second end to the actuation portion, the second arm being spaced apart from the first arm, whereby the first and second arms define a gap between them;

at least one strut interconnecting the first and second arms between the first and second ends thereof; and wherein, in use, the first arm is arranged to undergo expansion, thereby causing the actuator to apply a force to the actuation portion.

Preferably the first arm includes a first main body formed between the first and second ends of the first arm. Preferably the second arm includes a second main body formed between the first and second ends of the second arm. A second tab may extend from the second main body. The first one of the at least one strut may interconnect the first and second tabs.

Preferably the first and second tabs extend from respective thinned portions of the first and second main bodies.

Preferably the first arm includes a conductive layer that is conductively heated to cause, in use, the first arm to undergo thermal expansion relative to the second arm thereby to cause the actuator to apply a force to the actuation portion.

Preferably the first and second arms are substantially parallel and the strut is substantially perpendicular to the first and second arms.

Preferably a current is supplied in use, to the conductive layer through the supporting substrate.

Preferably the first and second arms are formed from substantially the same material. Preferably the actuator is manufactured by the steps of:

depositing and etching a first layer to form the first arm;

depositing and etching a second layer to form a sacrificial layer supporting structure over the first arm;

depositing and etching a third layer to form the second arm; and etching the sacrificial layer to form the gap between the first and second arms.

Preferably the first arm includes two first elongated flexible strips conductively interconnected at the second arm. Preferably the second arm includes two second elongated flexible strips. Preferably the actuation portion comprises a paddle structure.

Preferably the first arm is formed from titanium nitride. Preferably the second arm is formed from titanium nitride.

BRIEF DESCRIPTION OF THE DRAWINGS

Notwithstanding any other forms which may fall within the scope of the present invention, preferred forms of the invention will now be described, by way of example only, with reference to the accompanying drawings.

DETAILED DESCRIPTION OF THE DRAWINGS

Figure 1:
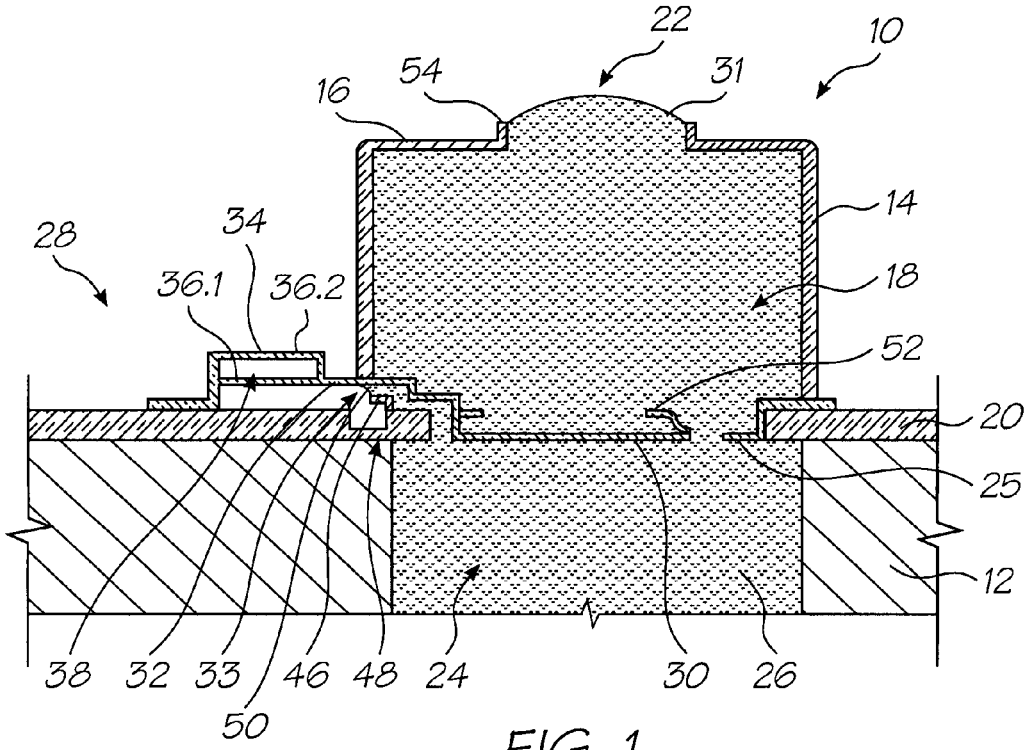
FIG. 1 is a schematic side-sectioned view of a nozzle arrangement of one embodiment of an integrated circuit device in accordance with the invention, in a pre-firing condition.
Figure 2:
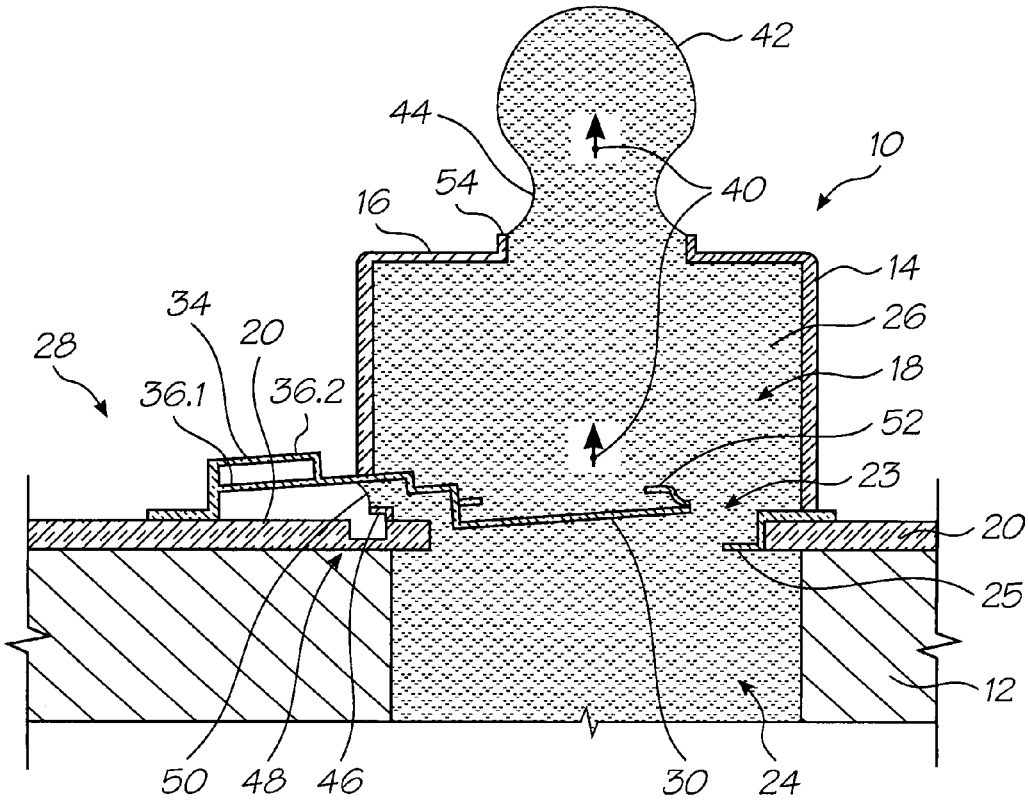
FIG. 2 is a schematic side-sectioned view of a nozzle arrangement of FIG. 1, in a firing condition.
Figure 3:
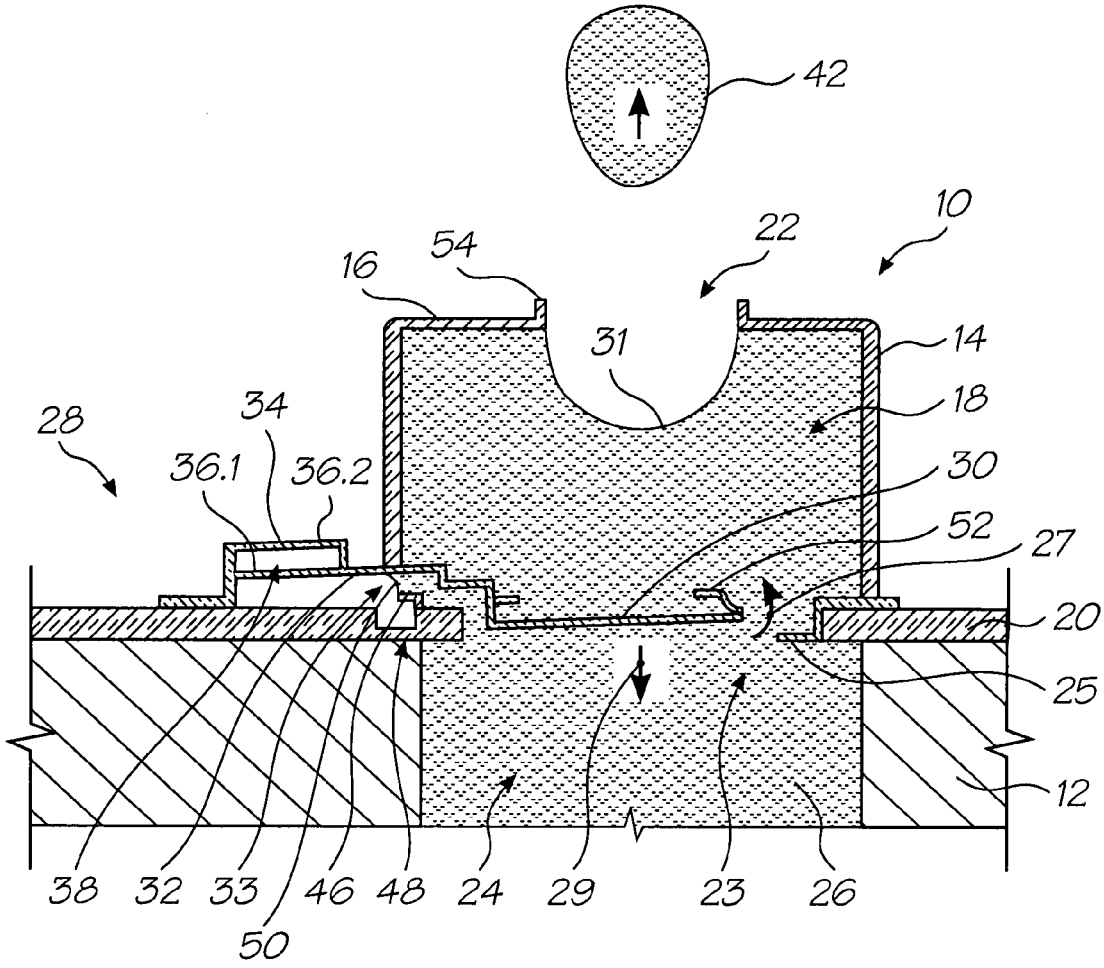
FIG. 3 is a schematic side-sectioned view of a nozzle arrangement of FIG. 1, in a post firing condition.

In FIGS. 1 to 3, reference numeral 10 generally indicates a first embodiment of a nozzle arrangement of an integrated circuit device, in accordance with the invention.

The nozzle arrangement 10 is one of a plurality that comprises the device. One has been shown simply for the sake of convenience.

In FIG. 1, the nozzle arrangement 10 is shown in a quiescent stage. In FIG. 2, the nozzle arrangement 10 is shown in an active, pre-ejection stage. In FIG. 3, the nozzle arrangement 10 is shown in an active, pre-ejection stage.

The nozzle arrangement 10 includes a wafer substrate 12. A layer of a passivation material 20, such as silicon nitride, is positioned on the wafer substrate 12. A nozzle chamber wall 14 and a roof wall 16 are positioned on the wafer substrate 12 to define a nozzle chamber 18. The roof wall 16 defines an ejection port 22 that is in fluid communication with the nozzle chamber 18.

An inlet channel 24 extends through the wafer substrate 12 and the passivation material 20 into the nozzle chamber 18 so that fluid to be ejected from the nozzle chamber 18 can be fed into the nozzle chamber 18. In this particular embodiment the fluid is ink, indicated at 26. Thus, the fluid ejection device of the invention can be in the form of an inkjet printhead chip.

The nozzle arrangement 10 includes a thermal actuator 28 for ejecting the fluid 26 from the nozzle chamber 18. The thermal actuator 28 includes a paddle 30 that is positioned in the nozzle chamber 18, between an outlet of the inlet channel 24 and the ejection port 22 so that movement of the paddle 30 towards and away from the ejection port 22 results in the ejection of fluid 26 from the ejection port.

The thermal actuator 28 includes an actuating arm 32 that extends through an opening 33 defined in the nozzle chamber wall 14 and is connected to the paddle 30.

The actuating arm 32 includes an actuating portion 34 that is connected to CMOS layers (not shown) positioned on the substrate 12 to receive electrical signals from the CMOS layers.

The actuating portion 34 has a pair of spaced actuating members 36. The actuating members 36 are spaced so that one of the actuating members 36.1 is spaced between the other actuating member 36.2 and the passivation layer 20 and a gap 38 is defined between the actuating members 36. Thus, for the sake of convenience, the actuating member 36.1 is referred to as the lower actuating member 36.1, while the other actuating member is referred to as the upper actuating member 36.2.

The lower actuating member 36.1 defines a heating circuit and is of a material having a coefficient of thermal expansion that permits the actuating member 36.1 to perform work upon expansion. The lower actuating member 36.1 is connected to the CMOS layers to the exclusion of the upper actuating member 36.2. Thus, the lower actuating member 36.1 expands to a significantly greater extent than the upper actuating member 36.2, when the lower actuating member 36.1 receives an electrical signal from the CMOS layers. This causes the actuating arm 32 to be displaced in the direction of the arrows 40 in FIG. 2, thereby causing the paddle 30 and thus the fluid 26 also to be displaced in the direction of the arrows 40. The fluid 26 thus defines a drop 42 that remains connected, via a neck 44 to the remainder of the fluid 26 in the nozzle chamber 18.

The actuating members 36 are of a resiliently flexible material. Thus, when the electrical signal is cut off and the lower actuating member 36.1 cools and contracts, the upper actuating member serves to drive the actuating arm 32 and paddle 30 downwardly in the direction of an arrow 29, thereby generating a reduced pressure in the nozzle chamber 18, which, together with the forward momentum of the drop 42 results in the separation of the drop 42 from the remainder of the fluid 26.

It is of importance to note that the gap 38 between the actuating members 36 serves to inhibit buckling of the actuating arm 32 as is explained in further detail below.

The nozzle chamber wall 14 defines a re-entrant portion 46 at the opening 33. The passivation layer 20 defines a channel 48 that is positioned adjacent the re-entrant portion 46. The re-entrant portion 46 and the actuating arm 32 provide points of attachment for a meniscus that defines a fluidic seal 50 to inhibit the egress of fluid 26 from the opening 33 while the actuating arm 32 is displaced. The channel 48 inhibits the wicking of any fluid that may be ejected from the opening 33.

A raised formation 52 is positioned on an upper surface of the paddle 30. The raised formation 52 inhibits the paddle 30 from making contact with a meniscus 31. Contact between the paddle 30 and the meniscus 31 would be detrimental to the operational characteristics of the nozzle arrangement 10.

A stepped formation 25 is positioned on the passivation material 20 defining an edge of the inlet channel 24. The stepped formation 25 is shaped and dimensioned so that, when the paddle 30 is displaced towards the ejection port 22, an opening 23 is defined between the paddle 30 and the formation 25 at a rate that facilitates the entry of fluid into the nozzle chamber 18 in the direction of arrows 27 in FIG. 3.

A nozzle rim 54 is positioned about the ejection port 22.

Figure 4:
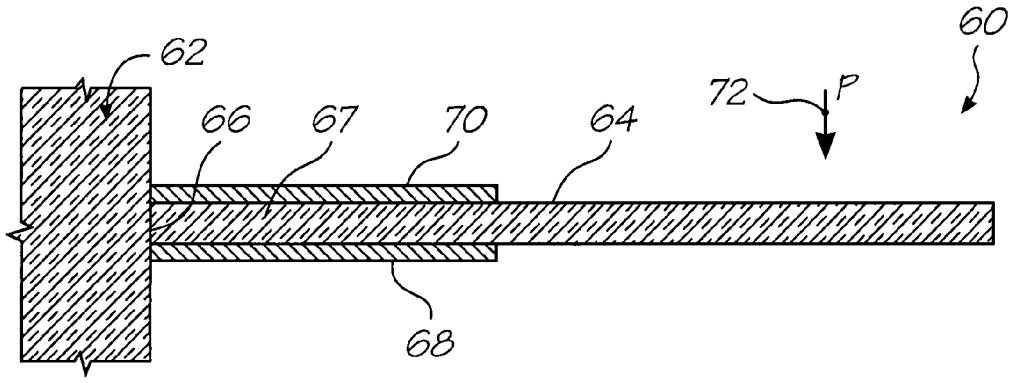
FIG. 4 (PRIOR ART)
FIG. 4 illustrates a prior art thermal bend actuator in a pre-firing condition.
Figure 5:
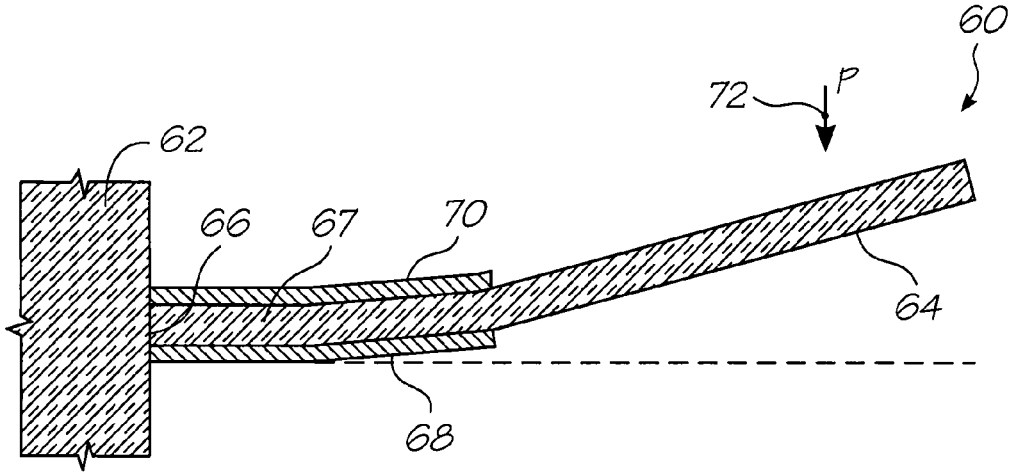
FIG. 5 (PRIOR ART)
FIG. 5 illustrates the actuator of FIG. 4 in a firing condition.
Figure 6:
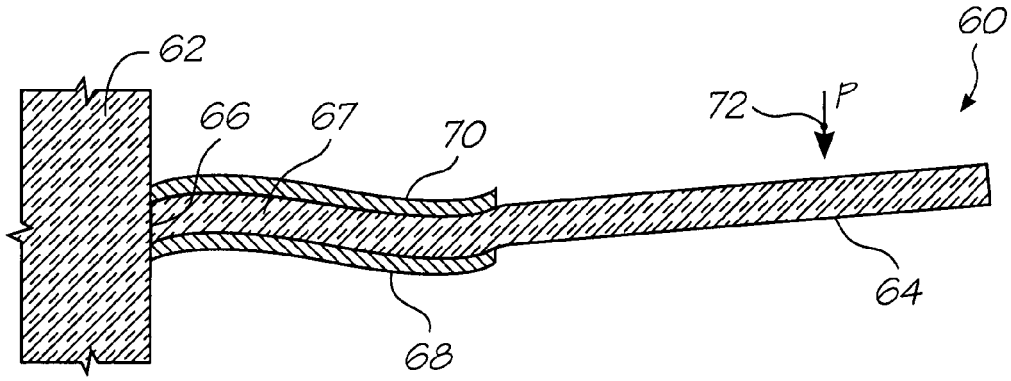
FIG. 6 (PRIOR ART)
FIG. 6 illustrates the actuator of FIG. 4 in a post-firing condition.

In FIGS. 4 to 6, reference numeral 60 generally indicates a thermal actuator of the type that the Applicant has identified as exhibiting certain problems and over which the present invention distinguishes.

The thermal actuator 60 is in the form of a thermal bend actuator that uses differential expansion as a result of uneven heating to generate movement and thus perform work.

The thermal actuator 60 is fast with a substrate 62 and includes an actuator arm 64 that is displaced to perform work. The actuator arm 64 has a fixed end 66 that is fast with the substrate 62. A fixed end portion 67 of the actuator arm 64 is sandwiched between and fast with a lower activating arm 68 and an upper activating arm 70. The activating arms 68, 70 are substantially the same to ensure that they remain in thermal equilibrium, for example during quiescent periods. The material of the arms 68, 70 is such that, when heated, the arms 68, 70 are capable of expanding to a degree sufficient to perform work.

The lower activating arm 68 is capable of being heated to the exclusion of the upper activating arm 70. It will be appreciated that this will result in a differential expansion being set up between the arms, with the result that the actuator arm 64 is driven upwardly to perform work against a pressure P, as indicated by the arrow 72.

In order to achieve this, the arms 68, 70 must be fast with the arm 64. It has been found that, if the arms 68, 70 exceed a particular length, then the arms 68, 70 and the fixed end portion 67 are susceptible to buckling as shown in FIG. 6. It will be appreciated that this is undesirable.

Figure 7:
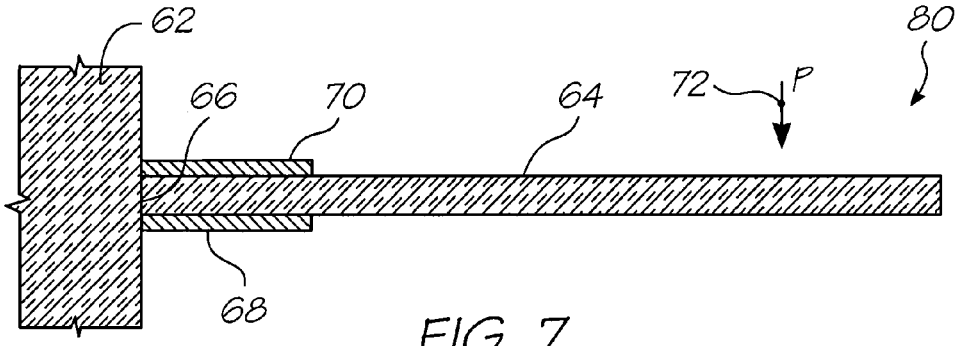
FIG. 7 illustrates a thermal bend actuator in a pre-firing condition to explain the invention.
Figure 8:
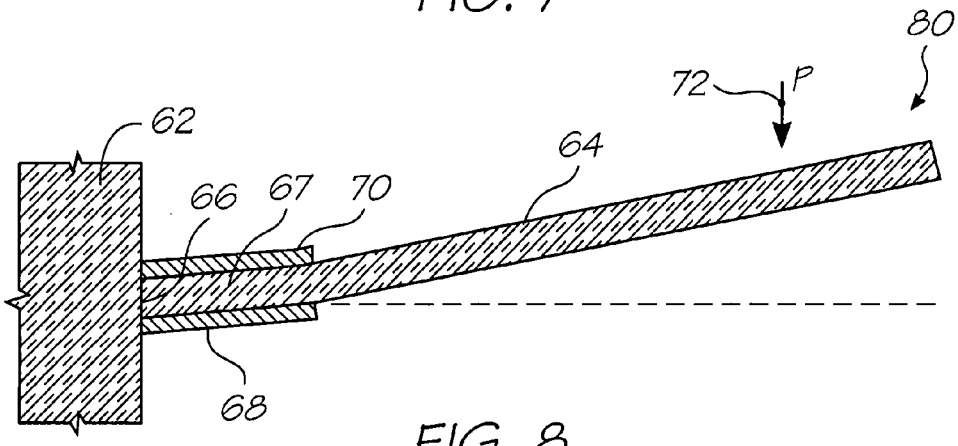
FIG. 8 illustrates the actuator of FIG. 7 in a firing condition.

In FIGS. 7 and 8, reference numeral 80 generally indicates a further thermal bend actuator by way of illustration of the principles of the present invention. With reference to FIGS. 4 to 6, like reference numerals refer to like parts, unless otherwise specified.

The thermal bend actuator 80 has shortened activation arms 68, 70. This serves significantly to reduce the risk of buckling as described above. However, it has been found that, to achieve useful movement, as shown in FIG. 8, it is necessary for the fixed end portion 67 to be subjected to substantial shear stresses. This can have a detrimental effect on the operational characteristics of the actuator 80. The high shear stresses can also result in delamination of the actuator arm 64.

Furthermore, in both the embodiments of the thermal actuator 60, 80, the temperature to which the lower activation arm can be heated is limited by characteristics of the fixed end portion 67, such as the melting point of the fixed end portion 67.

Figure 9:
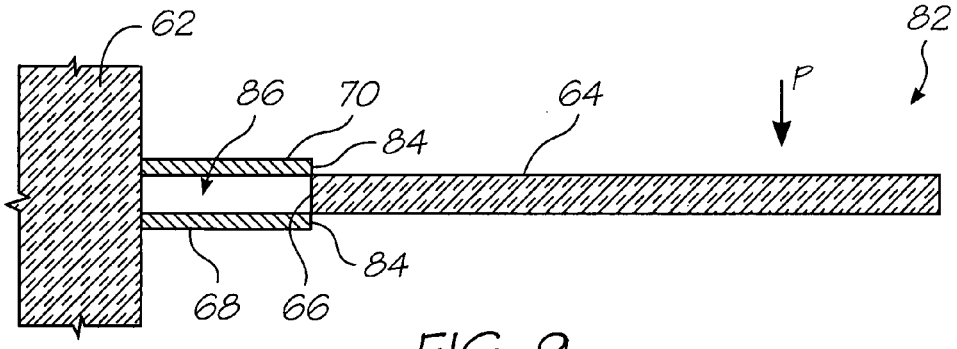
FIG. 9 illustrates a thermal bend actuator of an integrated circuit device of the invention in a pre-firing condition.
Figure 10:
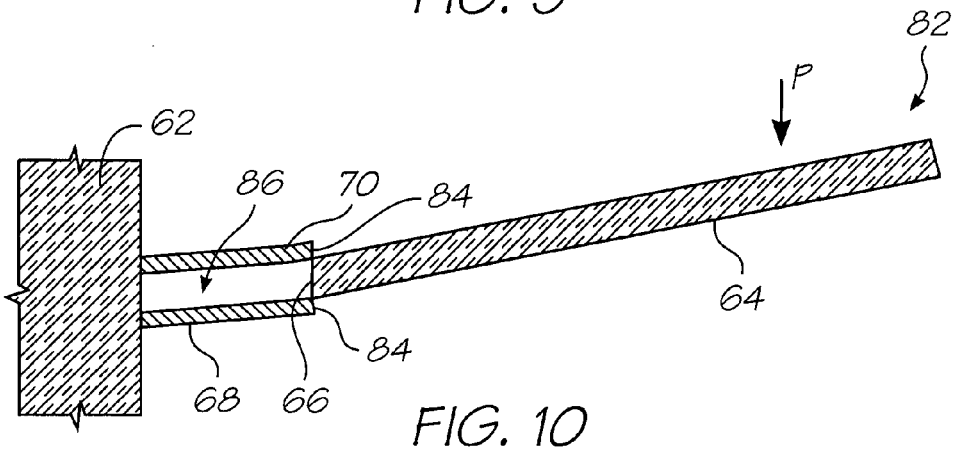
FIG. 10 illustrates the actuator of FIG. 9 in a firing condition.

Thus, the Applicant has conceived, schematically, the thermal bend actuator as shown in FIGS. 9 and 10. Reference numeral 82 refers generally to that thermal bend actuator. With reference to FIGS. 4 to 8, like reference numerals refer to like parts, unless otherwise specified.

The thermal bend actuator 82 does not include the fixed end portion 67. Instead, ends 84 of the activating arms 68, 70, opposite the substrate 62, are fast with the fixed end 66 of the actuator arm 64, instead of the fixed end 66 being fast with the substrate 62. Thus, the fixed end portion 67 is replaced with a gap 86, equivalent to the gap 38 described above. As a result, the activating arms 68, 70 can operate without being limited by the characteristics of the actuator arm 64. Further, shear stresses are not set up in the actuator arm 64 so that delamination is avoided. Buckling is also avoided by the configuration shown in FIGS. 9 and 10.

Figure 11:
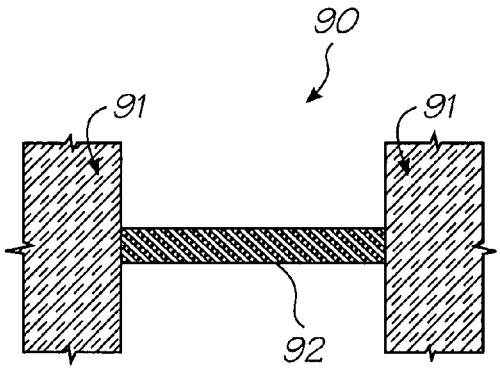
FIG. 11 is a schematic diagram of a thermal actuator indicating a problem addressed by the invention.

In FIG. 11, reference numeral 90 generally indicates a schematic layout of a thermal actuator for illustration of a problem that Applicant has identified with thermal actuators.

Figure 12:
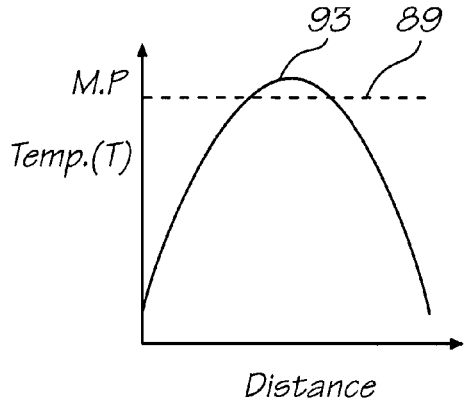
FIG. 12 is a graph of temperature with respect to distance for the actuator of FIG. 11.

The thermal actuator 90 includes an actuator arm 92. The actuator arm 92 is positioned between a pair of heat sink members 91. It will be appreciated that when the arm 92 is heated, the resultant thermal expansion will result in the heat sink members 91 being driven apart. The graph shown in FIG. 12 is a temperature v. distance graph that indicates the relationship between the temperature applied to the actuator arm 92 and the position along the actuator arm 92.

As can be seen from the graph, at some point 93 intermediate the heat sinks 91, the melting point, indicated at 89, of the actuator arm 92, is exceeded. This is clearly undesirable, as this would cause a breakdown in the operation of the actuator arm 92. The graph clearly indicates that the level of heating of the actuator arm 92 varies significantly along the length of the actuator arm 92, which is undesirable.

Figure 13:
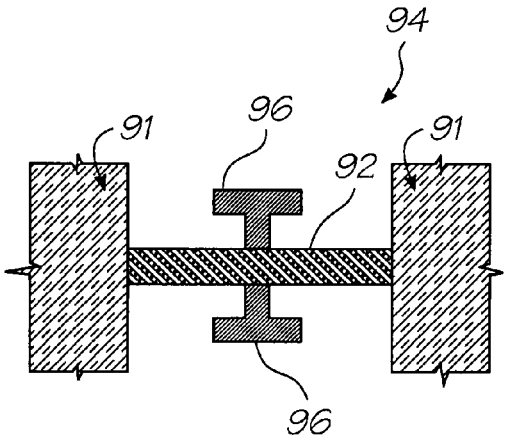
FIG. 13 is a schematic diagram of an arm indicating an aspect of the invention.

In FIG. 13, reference numeral 94 generally indicates a further layout of a thermal actuator, for illustrative purposes. With reference to FIG. 11, like reference numerals refer to like parts, unless otherwise specified.

Figure 14:
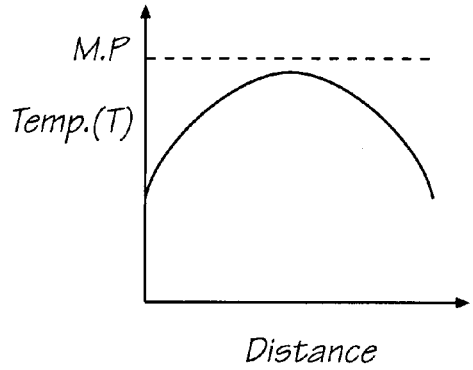
FIG. 14 is a graph of temperature with respect to distance for the am of FIG. 13.

The thermal actuator 94 includes a pair of heat sinks 96 that are positioned on the actuator arm 92 between the heat sink members 91. The graph shown in FIG. 14 is a graph of temperature v. distance along the actuator arm 92. As can be seen in that graph, that point intermediate the heat sink members 91 is inhibited from reaching the melting point of the actuator arm 92. Furthermore, the actuator arm 92 is heated more uniformly along its length than in the thermal actuator 80.

Figure 15:
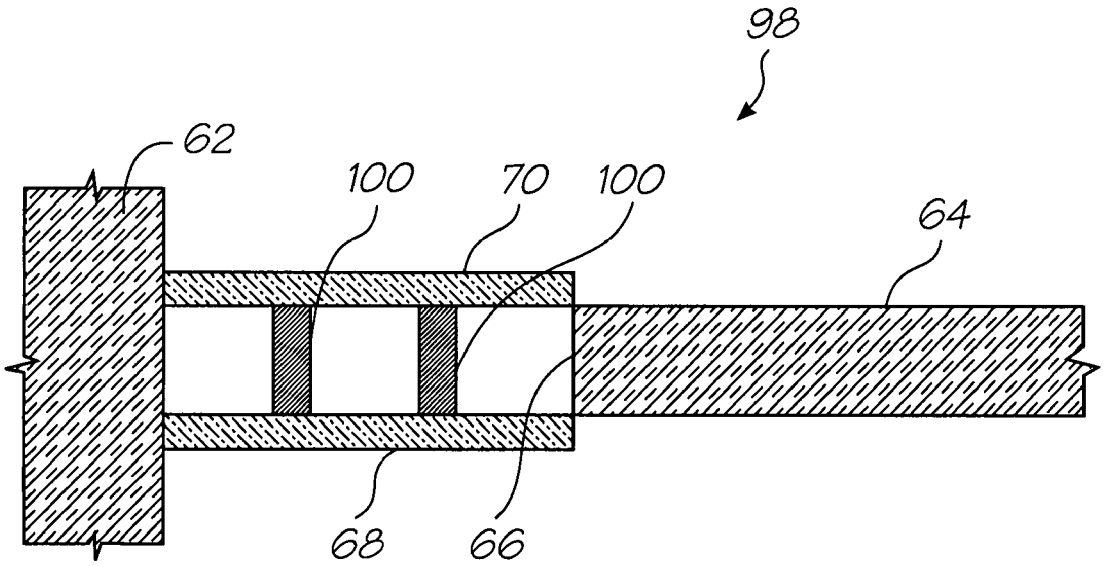
FIG. 15 illustrates schematically a thermal bend actuator of an integrated circuit device of the invention.

In FIG. 15, reference numeral 98 generally indicates a thermal actuator that incorporates some of the principles of the present invention. With reference to the preceding drawings, like reference numerals refer to like parts, unless otherwise specified.

The thermal actuator 98 is similar to the thermal actuator 82 shown in FIGS. 9 and 10. However, further to enhance the operational characteristics of the thermal actuator 98, a pair of heat sinks 100 is positioned in the gap 86, in contact with both the upper and lower activation arms 68, 70. Furthermore, the heat sinks 100 are configured to define a pair of spaced struts to provide the thermal actuator 98 with integrity and strength. The spaced struts 100 serve to inhibit buckling as the arm 64 is displaced.

Figure 58:
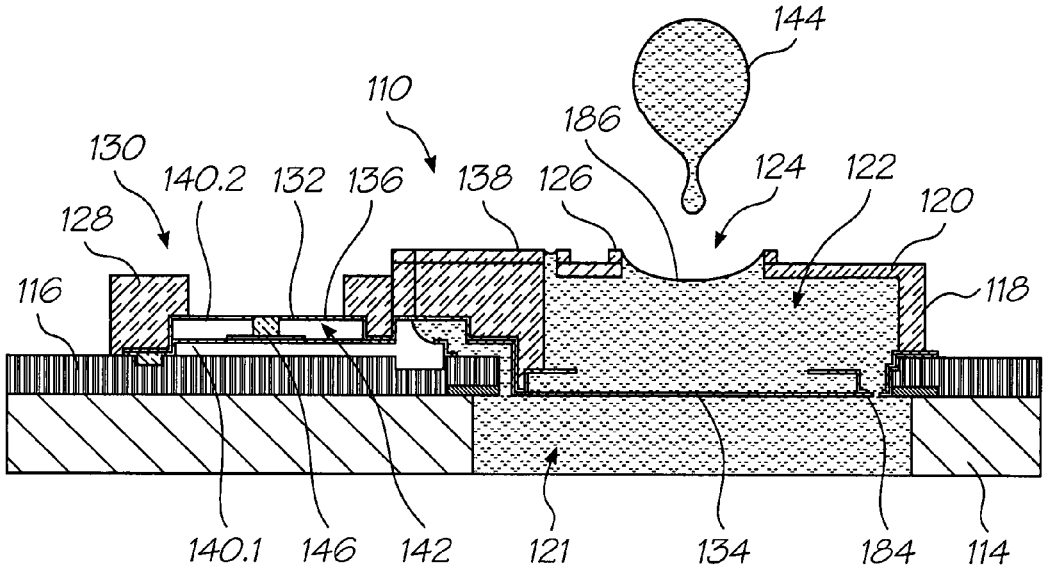
FIG. 58 is a side-sectioned view of the nozzle arrangement of FIG. 57.
Figure 59:
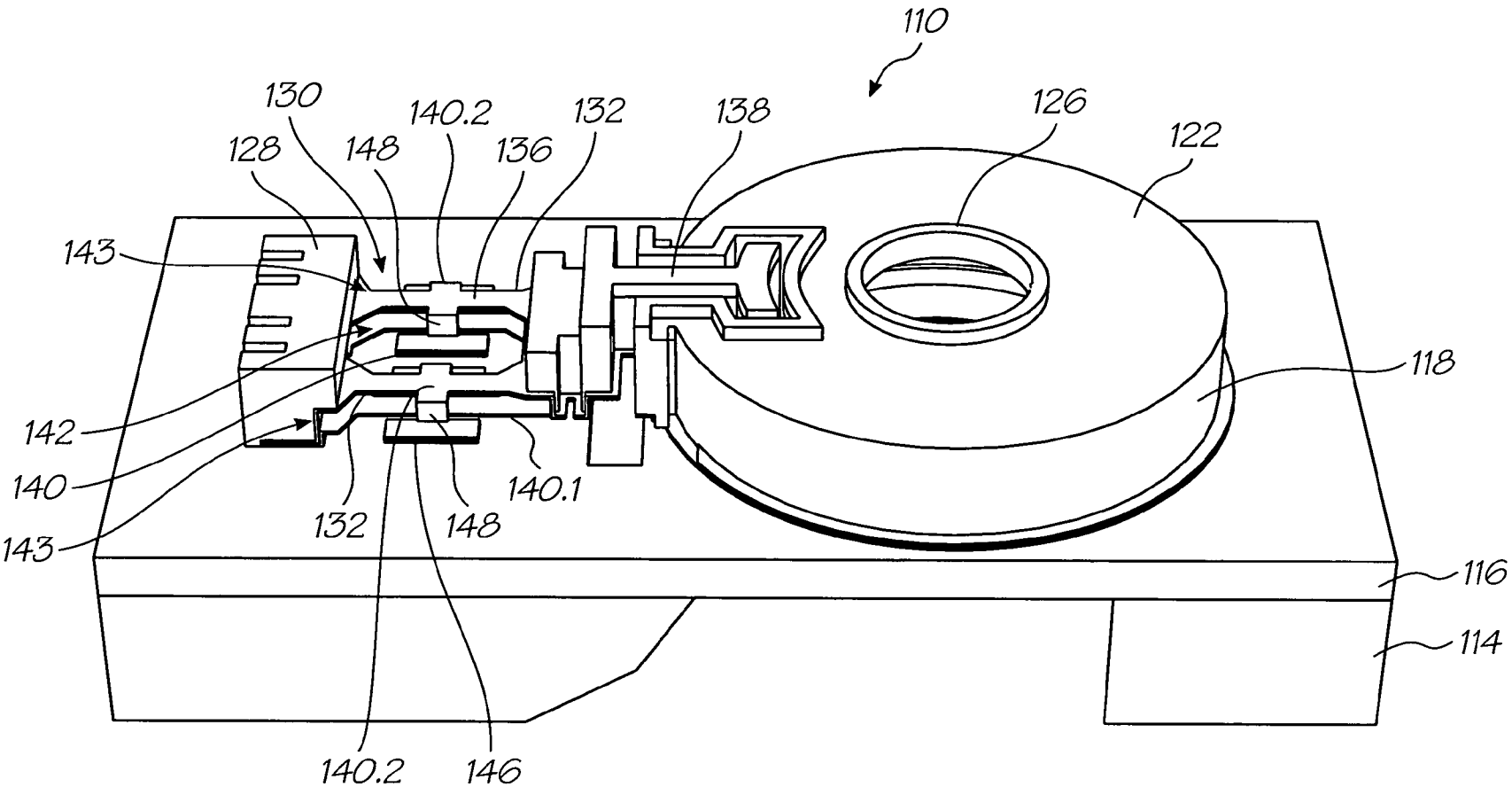
FIG. 59 is a perspective view of the nozzle arrangement.
Figure 60:
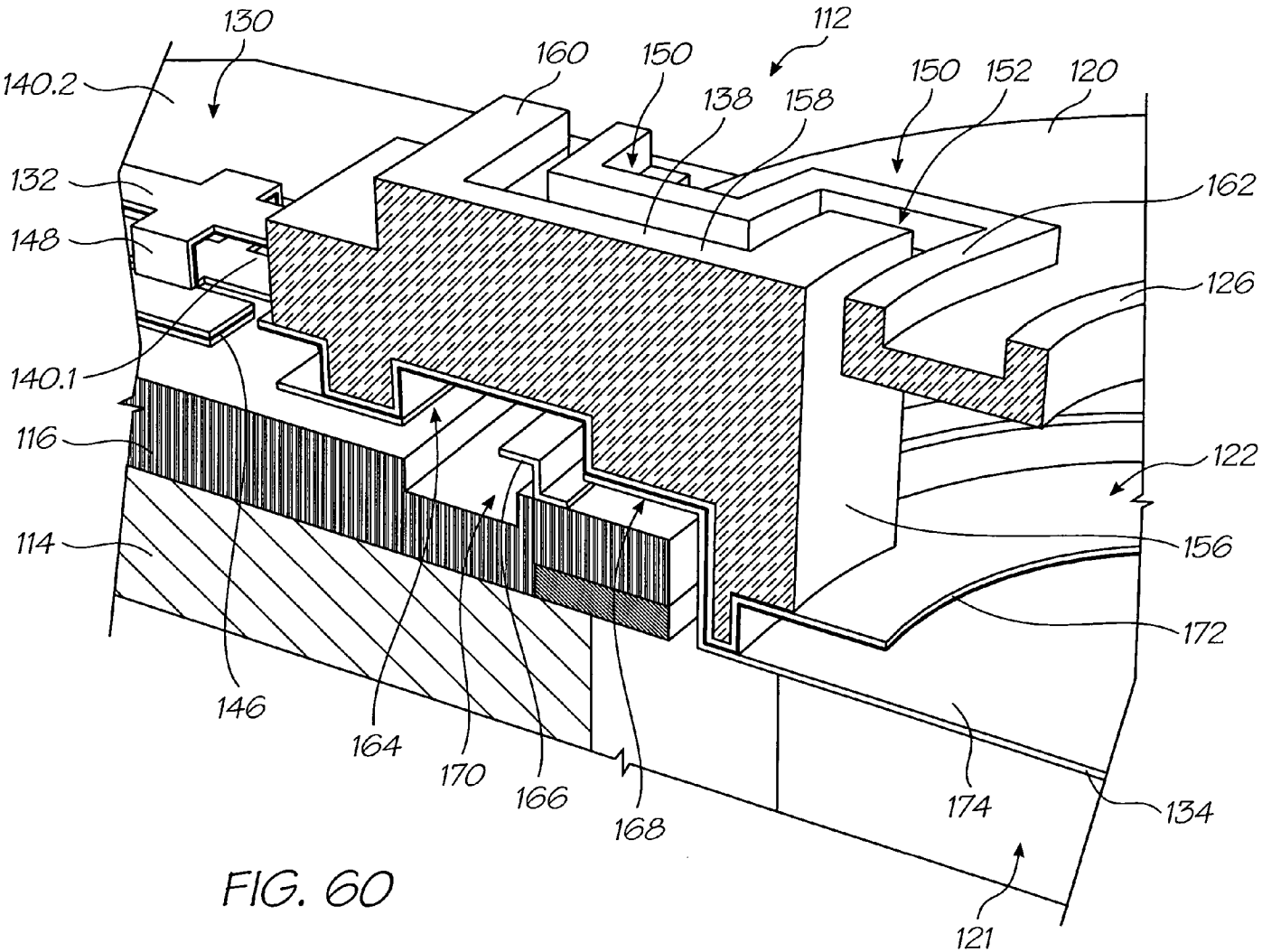
FIG. 60 is a detailed sectioned perspective view showing an arrangement of an actuator arm and nozzle chamber walls of the nozzle arrangement.
Figure 61:
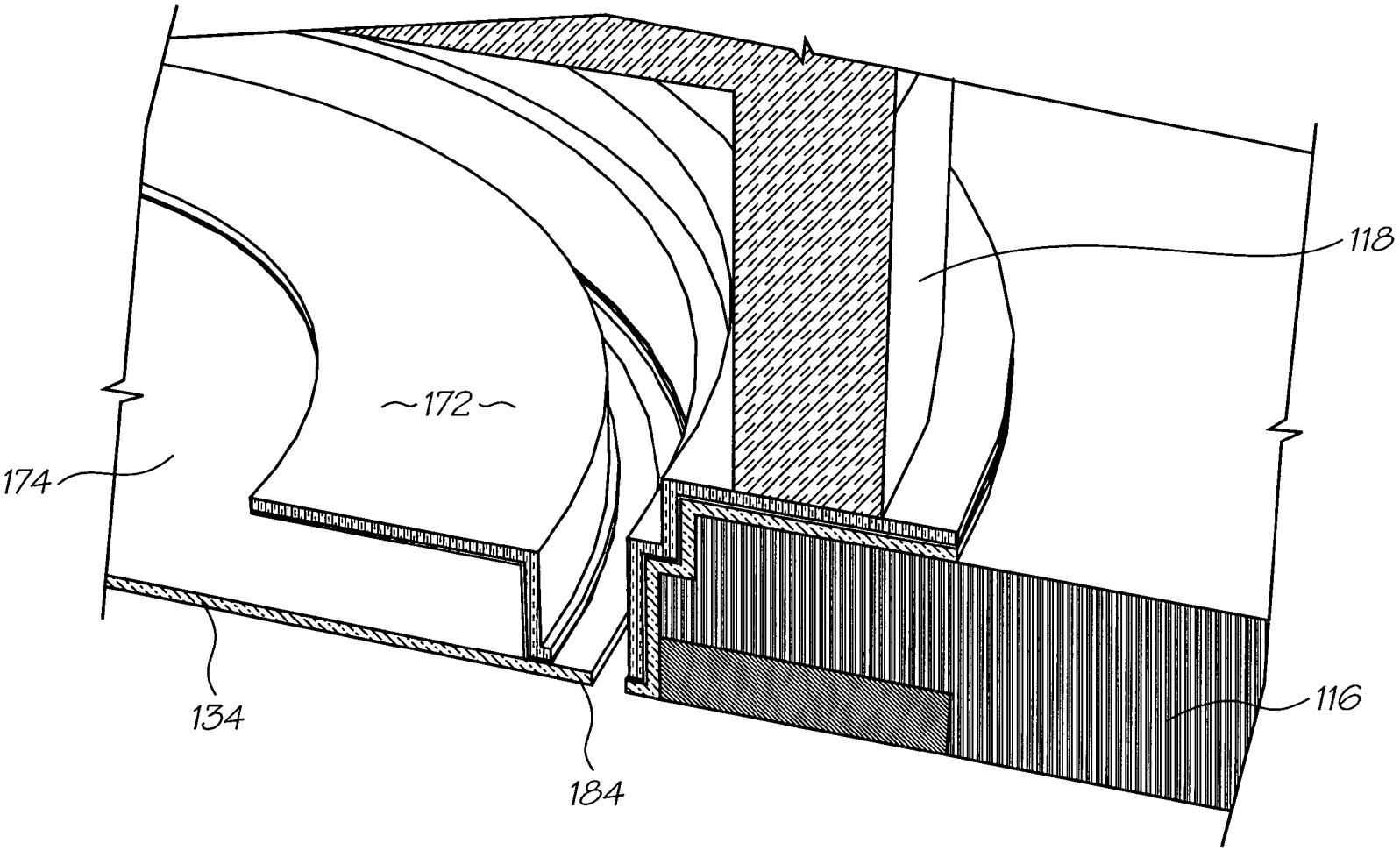
FIG. 61 is a detailed sectioned perspective view of a paddle and fluid channel of the nozzle arrangement.
Figure 62:
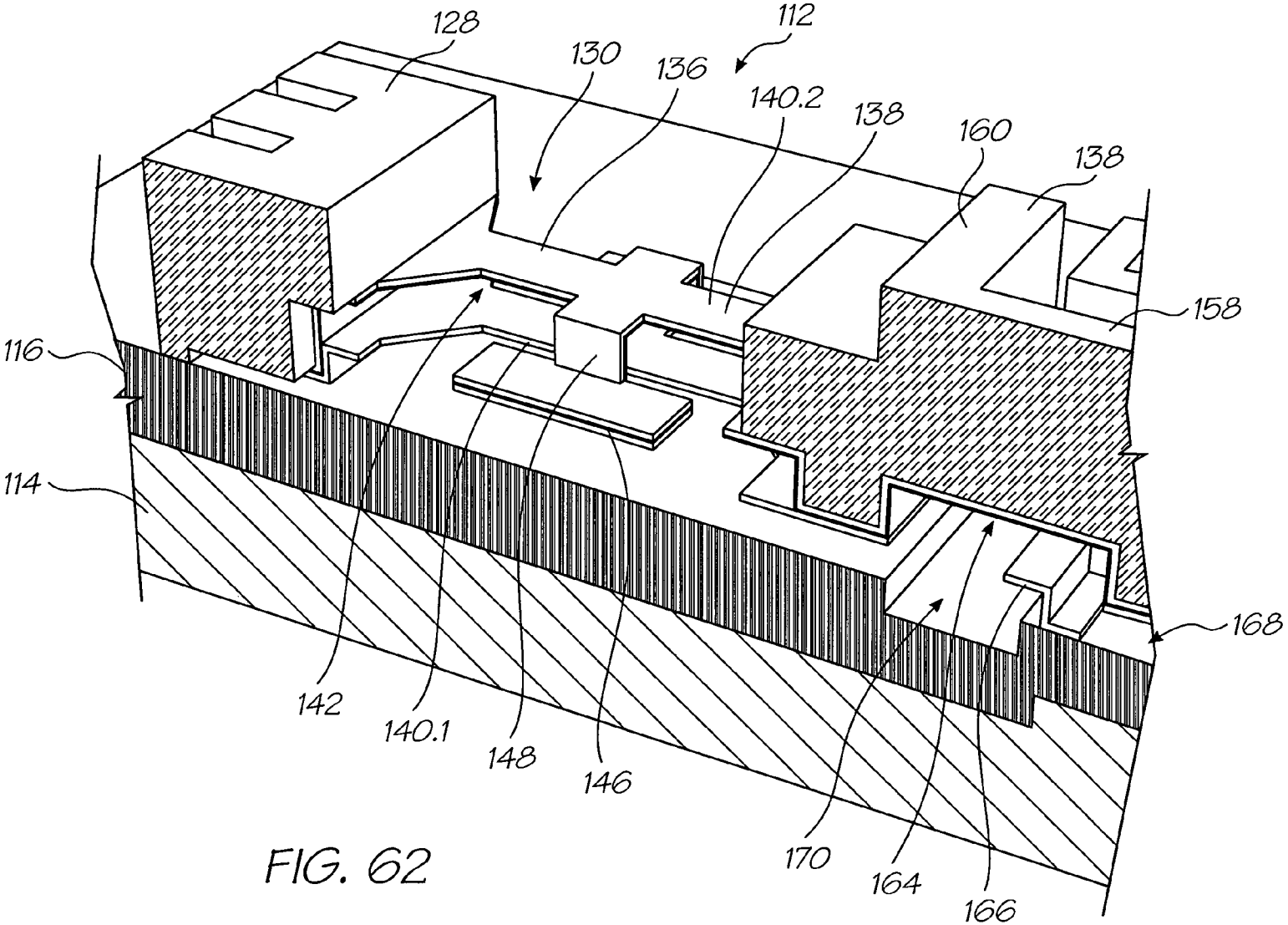
FIG. 62 is a detailed sectioned view of part of the actuator arm of the nozzle arrangement.

In FIGS. 55 to 59, reference numeral 110 generally indicates a second embodiment of a nozzle arrangement of an integrated circuit device, in accordance with the invention, part of which is generally indicated by reference numeral 112 in FIGS. 60 to 62.

The device 112 includes a wafer substrate 114. A fluid passivation layer in the form of a layer of silicon nitride 116 is positioned on the wafer substrate 114. A cylindrical nozzle chamber wall 118 is positioned on the silicon nitride layer 116. A roof wall 120 is positioned on the nozzle chamber wall 118 so that the roof wall 120 and the nozzle chamber wall 118 define a nozzle chamber 122.

A fluid inlet channel 121 is defined through the substrate 114 and the silicon nitride layer 116.

The roof wall 120 defines a fluid ejection port 124. A nozzle rim 126 is positioned about the fluid ejection port 124.

An anchoring member 128 is mounted on the silicon nitride layer 116. A thermal actuator 130 is fast with the anchoring member 128 and extends into the nozzle chamber 122 so that, on displacement of the thermal actuator 130, fluid is ejected from the fluid ejection port 124. The thermal actuator 130 is fast with the anchoring member 128 to be in electrical contact with CMOS layers (not shown) positioned on the wafer substrate 114 so that the thermal actuator 130 can receive an electrical signal from the CMOS layers.

The thermal actuator 130 includes an actuator arm 132 that is fast with the anchoring member 128 and extends towards the nozzle chamber 122. A paddle 134 is positioned in the nozzle chamber 122 and is fast with an end of the actuator arm 132.

The actuator arm 132 includes an actuating portion 136 that is fast with the anchoring member 128 at one end and a sealing structure 138 that is fast with the actuating portion at an opposed end. The paddle 134 is fast with the sealing structure 138 to extend into the nozzle chamber 122.

The actuating portion 136 includes a pair of spaced substantially identical activating arms 140. One of the activating arms 140.1 is positioned between the other activating arm 140.2 and the silicon nitride layer 116. A gap 142 is defined between the arms 140 and is equivalent to the gap 38 described with reference to FIGS. 1 to 3.

As can be seen in FIG. 59, the actuating portion 136 is divided into two identical portions 143 that are spaced in a plane that is parallel to the substrate 114.

The activating arm 140.1 is of a conductive material that has a coefficient of thermal expansion that is sufficient to permit work to be harnessed from thermal expansion of the activating arm 140.1. The activating arm 140.1 defines a resistive heating circuit that is connected to the CMOS layers to receive an electrical current from the CMOS layers, so that the activating arm 140.1 undergoes thermal expansion. The activating arm 140.2, on the other hand, is not connected to the CMOS layers and therefore undergoes a negligible amount of expansion, if any. This sets up differential expansion in the actuation portion 136 so that the actuating portion 136 is driven away from the silicon nitride layer 116 and the paddle 134 is driven towards the ejection port 124 to generate a drop 144 of fluid that extends from the port 124. When the electrical current is cut off, the resultant cooling of the actuating portion 136 causes the arm 140.1 to contract so that the actuating portion 136 moves back to a quiescent condition towards the silicon nitride layer 116. The actuator arm 132 is also of a resiliently flexible material. This enhances the movement towards the silicon nitride layer 116.

Figure 57:
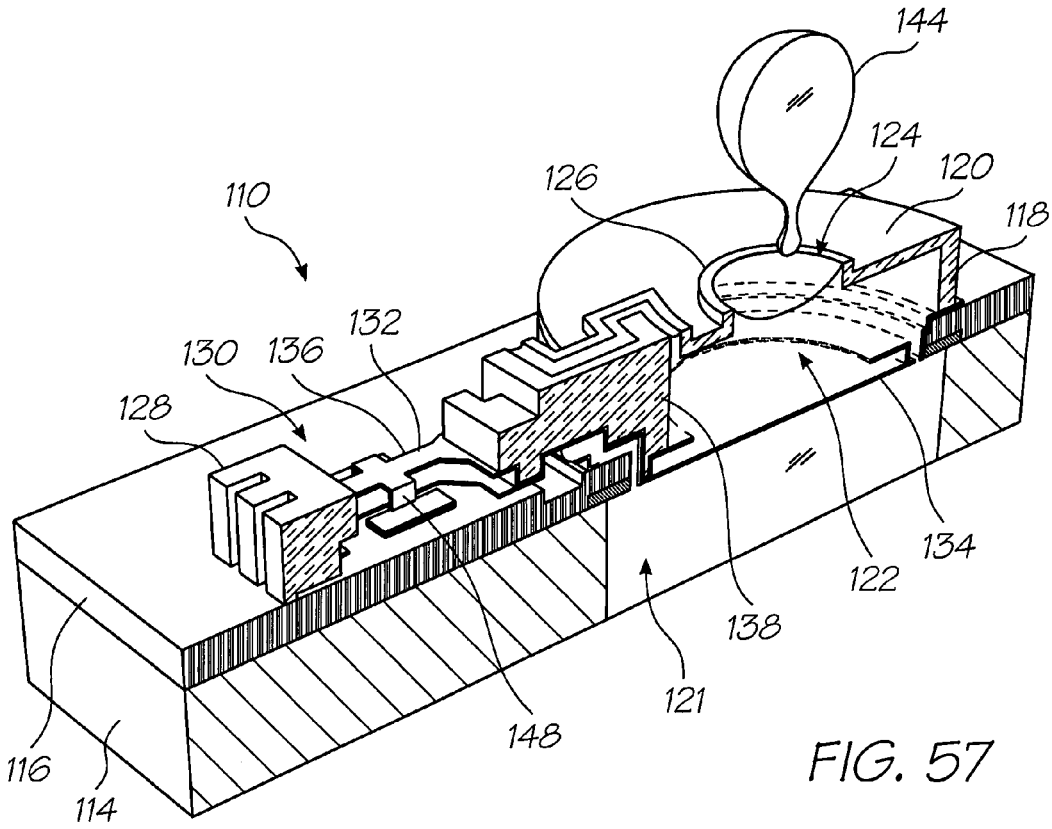
FIG. 57 is a side-sectioned perspective view of the nozzle arrangement in a post-firing condition.

As a result of the paddle 134 moving back to its quiescent condition, a fluid pressure within the nozzle chamber is reduced and the fluid drop 144 separates as a result of the reduction in pressure and the forward momentum of the fluid drop 144, as shown in FIGS. 57 and 58. In use, the CMOS layers can generate a high frequency electrical potential so that the actuator arm is able to oscillate at that frequency, thereby permitting the paddle 134 to generate a stream of fluid drops.

A heat sink member 146 is mounted on the activating arm 140.1. The heat sink member 146 serves to ensure that a temperature gradient along the arm 140.1 does not peak excessively at or near a centre of the arm 140.1. Thus, the arm 140.1 is inhibited from reaching its melting point while still maintaining suitable expansion characteristics.

A strut 148 is connected between the activating arms 140 to ensure that the activating arms 140 do not buckle as a result of the differential expansion of the activating arms 140. Detail of the strut 148 is shown in FIG. 62.

The purpose of the sealing structure 138 is to permit movement of the actuating arm and the paddle 134 while inhibiting leakage of fluid from the nozzle chamber 122. This is achieved by the roof wall 120, the nozzle chamber wall 118 and the sealing structure 138 defining complementary formations 150 that, in turn, with the fluid, set up fluidic seals which accommodate such movement. These fluidic seals rely on the surface tension of the fluid to retain a meniscus that prevents the fluid from escaping from the nozzle chamber 122.

The sealing structure 138 has a generally I-shaped profile when viewed in plan. Thus, the sealing structure 138 has an arcuate end portion 156, a leg portion 158 and a rectangular base portion 160, the leg portion 158 interposed between the end portion 156 and the base portion 160, when viewed in plan. The roof wall 120 defines an arcuate slot 152 which accommodates the end portion 156 and the nozzle chamber wall 118 defines an opening into the arcuate slot 152, the opening being dimensioned to accommodate the leg portion 158. The roof wall 120 defines a ridge 162 about the slot 152 and part of the opening. The ridge 162 and edges of the end portion 156 and leg portion 158 of the sealing structure 138 define purchase points for a meniscus that is generated when the nozzle chamber 122 is filled with fluid, so that a fluidic seal is created between the ridge 162 and the end and leg portions 156, 158.

As can be seen in FIG. 60, a transverse profile of the sealing structure 138 reveals that the end portion 156 extends partially into the fluid inlet channel 121 so that it overhangs an edge of the silicon nitride layer 116. The leg portion 158 defines a recess 164. The nozzle chamber wall 118 includes a re-entrant formation 166 that is positioned on the silicon nitride layer 116. Thus, a tortuous fluid flow path 168 is defined between the silicon nitride layer 116, the re-entrant formation 166, and the end and leg portions 156, 158 of the sealing structure 138. This serves to slow the flow of fluid, allowing a meniscus to be set up between the re-entrant formation 166 and a surface of the recess 164.

A channel 170 is defined in the silicon nitride layer 116 and is aligned with the recess 164. The channel 170 serves to collect any fluid that may be emitted from the tortuous fluid flow path 168 to inhibit wicking of that fluid along the layer 116.

The paddle 134 has a raised formation 172 that extends from an upper surface 174 of the paddle 134. Detail of the raised formation 172 can be seen in FIG. 61. The raised formation 172 is essentially the same as the raised formation 52 of the first embodiment. The raised formation 172 thus prevents the surface 174 of the paddle 134 from making contact with a meniscus 186, which would be detrimental to the operating characteristics of the nozzle arrangement 110. The raised formation 172 also serves to impart rigidity to the paddle 134, thereby enhancing the operational efficiency of the paddle 134.

Importantly, the nozzle chamber wall 118 is shaped so that, as the paddle 134 moves towards the fluid ejection port 124 a sufficient increase in a space between a periphery 184 of the paddle 134 and the nozzle chamber wall 118 takes place to allow for a suitable amount of fluid to flow rapidly into the nozzle chamber 122. This fluid is drawn into the nozzle chamber 122 when the meniscus 186 re-forms as a result of surface tension effects. This allows for refilling of the nozzle chamber 122 at a suitable rate.

Figure 63:
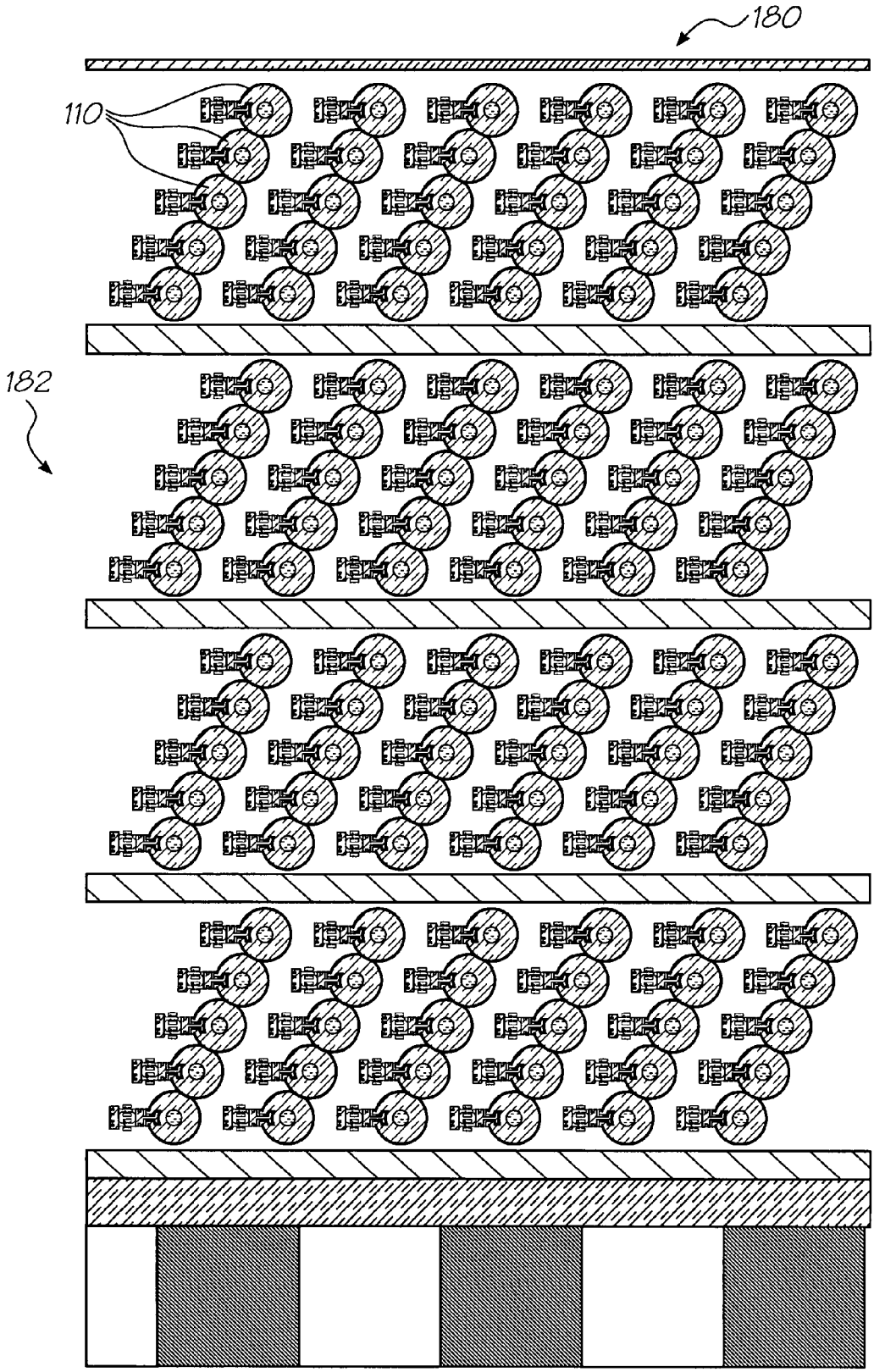
FIG. 63 is a top plan view of an array of the nozzle arrangements.
Figure 64:
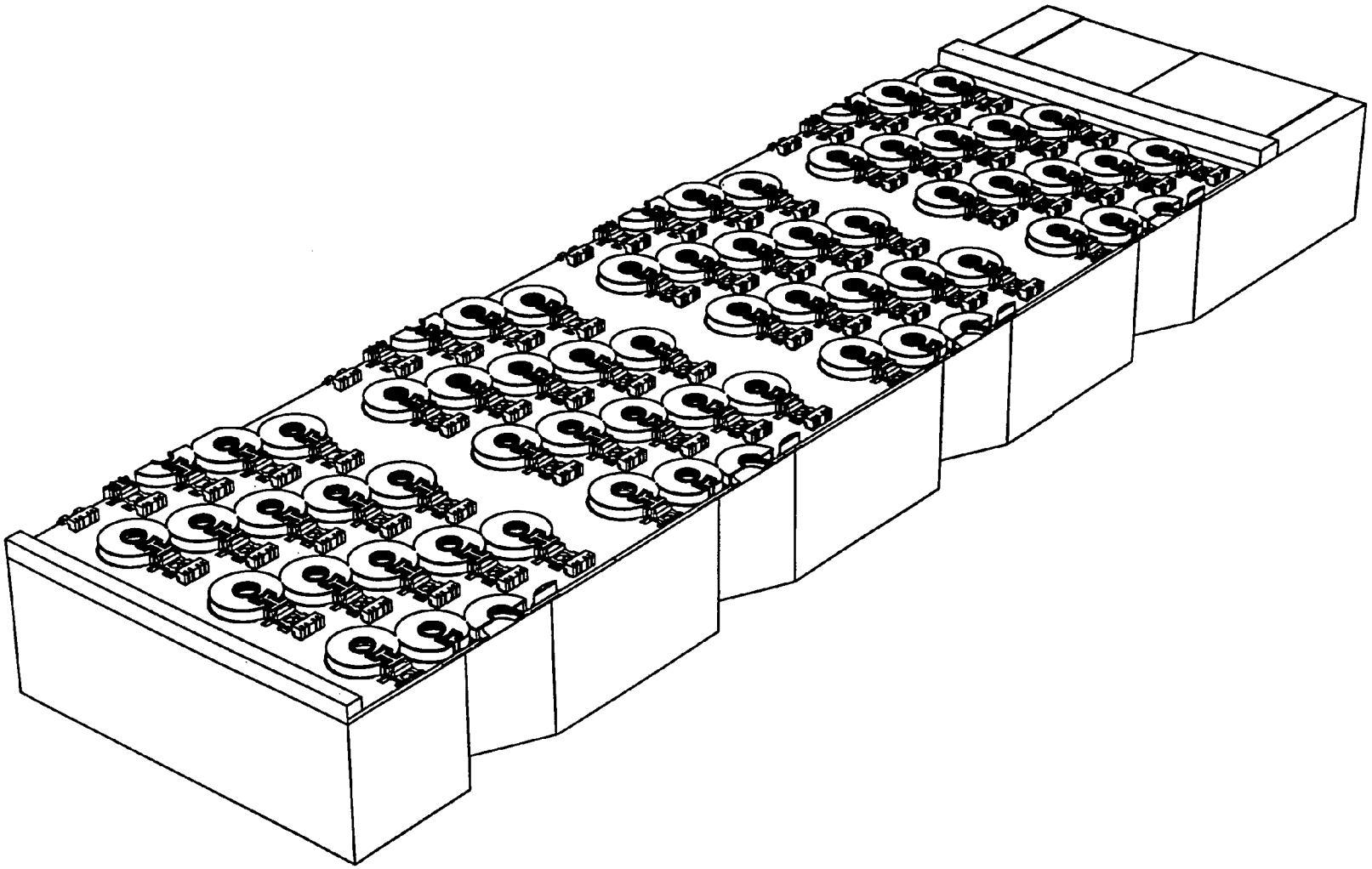
FIG. 64 is a perspective view of the array of nozzle arrangements.
Figure 65:
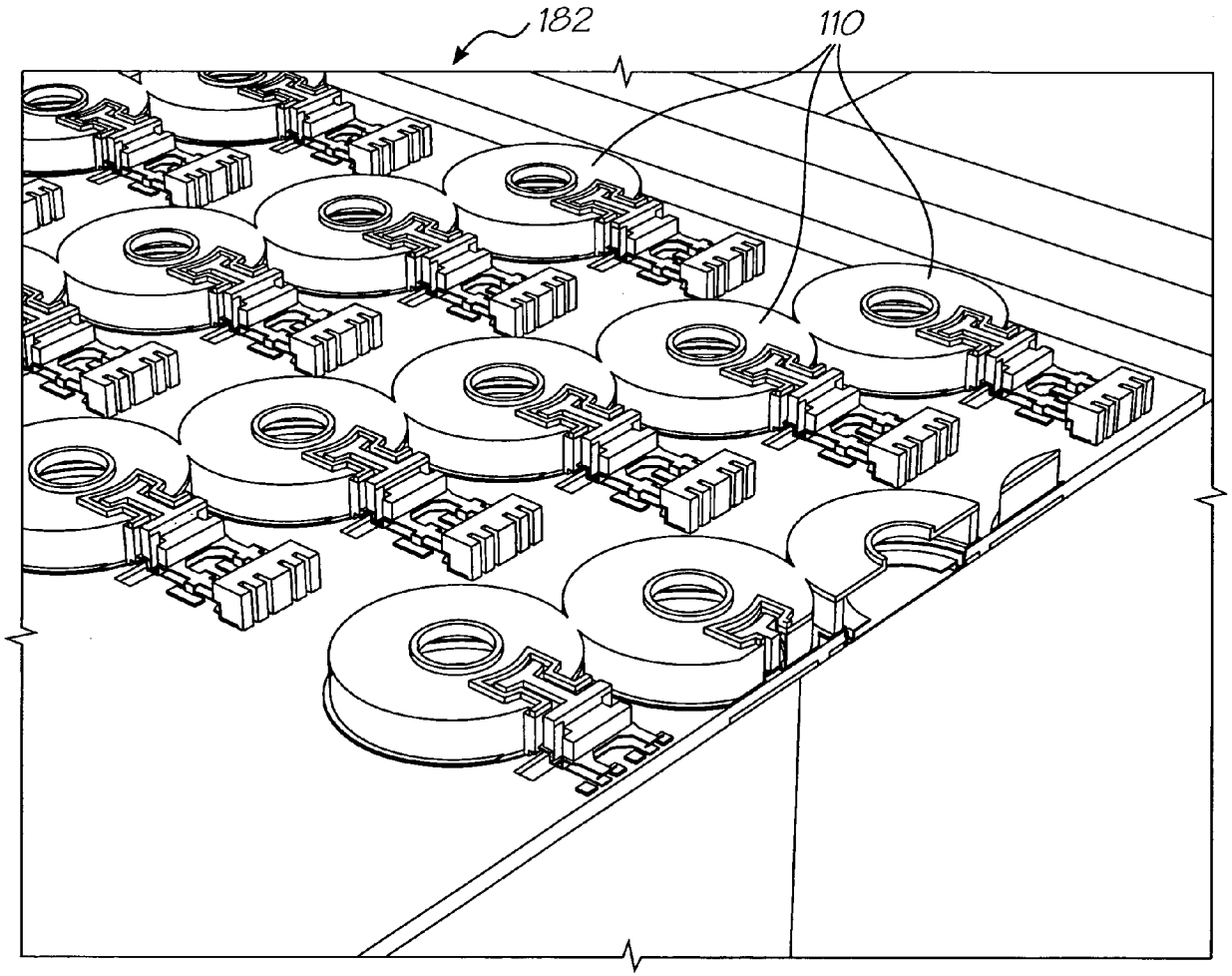
FIG. 65 is a detailed perspective view of the array of nozzle arrangements.

In FIGS. 63 and 64, reference numeral 180 generally indicates an integrated circuit device that incorporates a plurality of the nozzle arrangements 110.

The plurality of the nozzle arrangements 110 are positioned in a predetermined array 182 that spans a printing area. It will be appreciated that each nozzle arrangement 110 can be actuated with a single pulse of electricity such as that which would be generated with an "on" signal. It follows that printing by the chip 180 can be controlled digitally right up to the operation of each nozzle arrangement 110.

Figure 16:
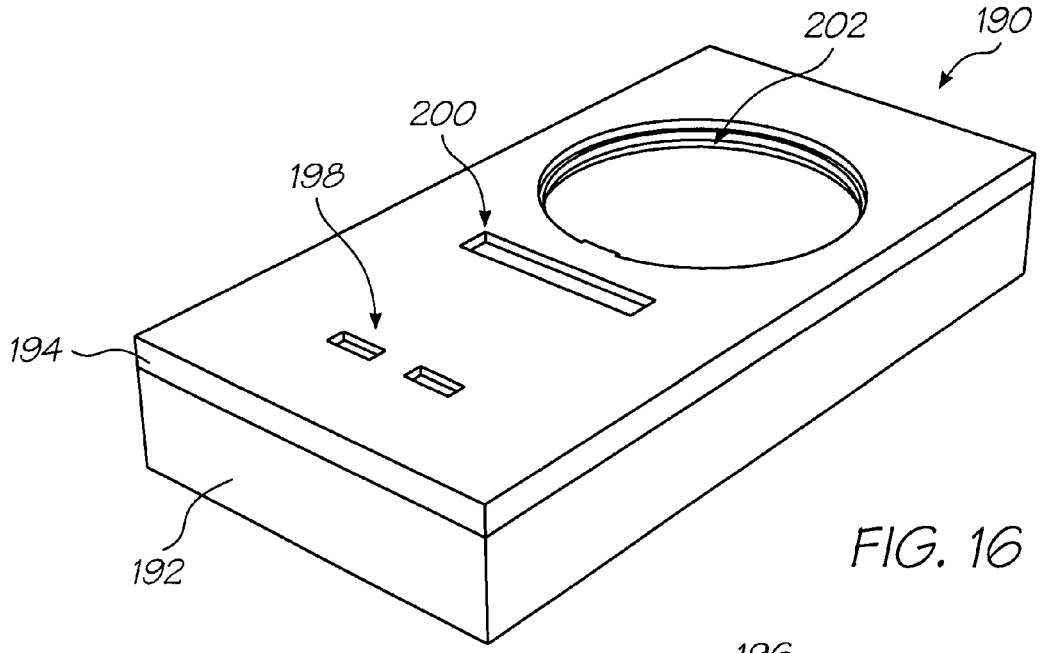
FIG. 16 is a side perspective view of a CMOS wafer prior to fabrication of one of a plurality of nozzle arrangements of a second embodiment of an integrated circuit device in accordance with the invention.
Figure 18:
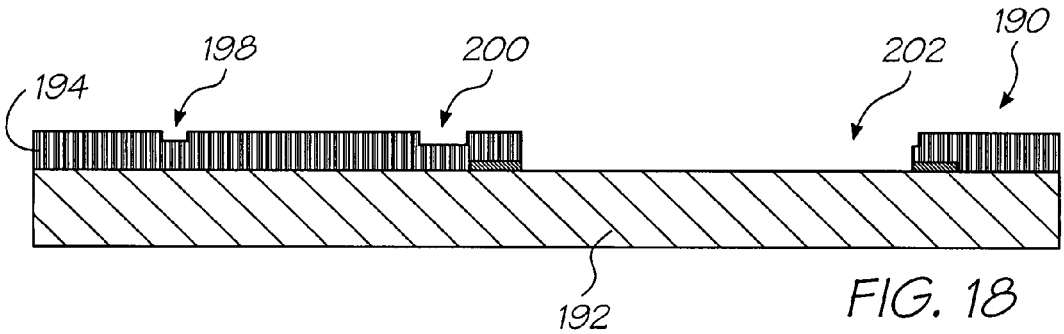
FIG. 18 is a side-sectioned view of the wafer of FIG. 16.

In FIGS. 16 and 18, reference numeral 190 generally indicates a wafer substrate 192 with multiple CMOS layers 194 in an initial stage of fabrication of the nozzle arrangement 110, in accordance with the invention. This form of fabrication is based on integrated circuit fabrication techniques. As is known, such techniques use masks and deposition, developing and etching processes. Furthermore, such techniques usually involve the replication of a plurality of identical units on a single wafer. Thus, the fabrication process described below is easily replicated to achieve the chip 180. Thus, for convenience, the fabrication a single nozzle arrangement 110 is described with the understanding that the fabrication process is easily replicated to achieve the device 180.

Figure 17:
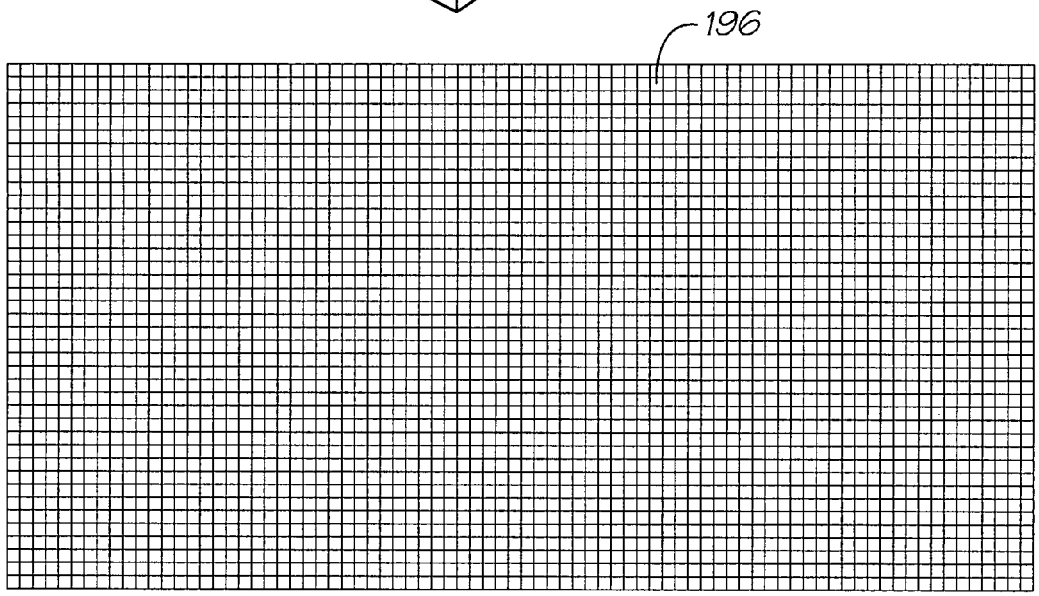
FIG. 17 illustrates, schematically, multiple CMOS masks used in the fabrication of the CMOS wafer.

In FIG. 17, reference numeral 196 is a mask used for the fabrication of the multiple CMOS layers 194.

The CMOS layers 194 are fabricated to define a connection zone 198 for the anchoring member 128. The CMOS layers 194 also define a recess 200 for the channel 170. The wafer substrate 192 is exposed at 202 for future etching of the fluid inlet channel 121.

Figure 19:
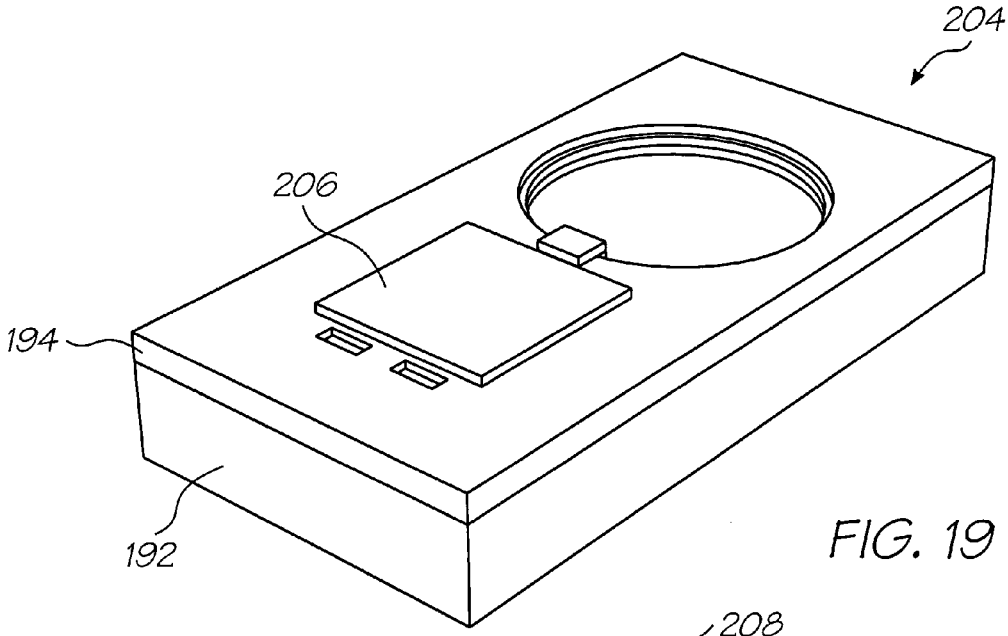
FIG. 19 is a perspective view of the wafer of FIG. 16 with a first sacrificial layer deposited onto the wafer.
Figure 21:
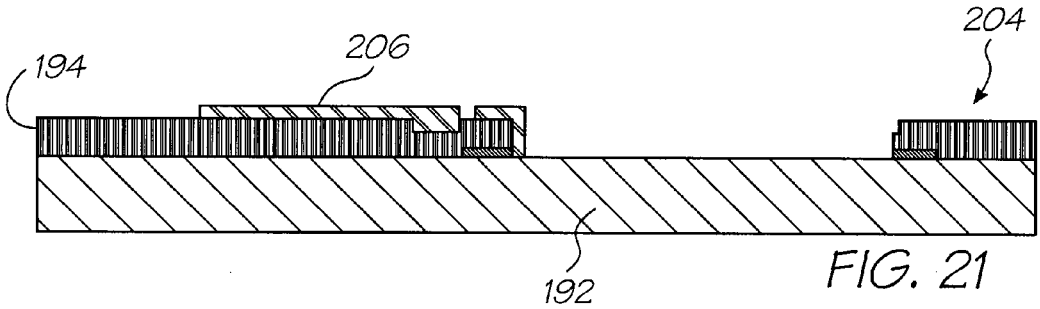
FIG. 21 is a side-sectioned view of the wafer of FIG. 19.

In FIGS. 19 and 21, reference numeral 204 generally indicates the structure 190 with a 1-micron thick layer of photosensitive, sacrificial polyimide 206 spun on to the structure 190 and developed.

Figure 20:
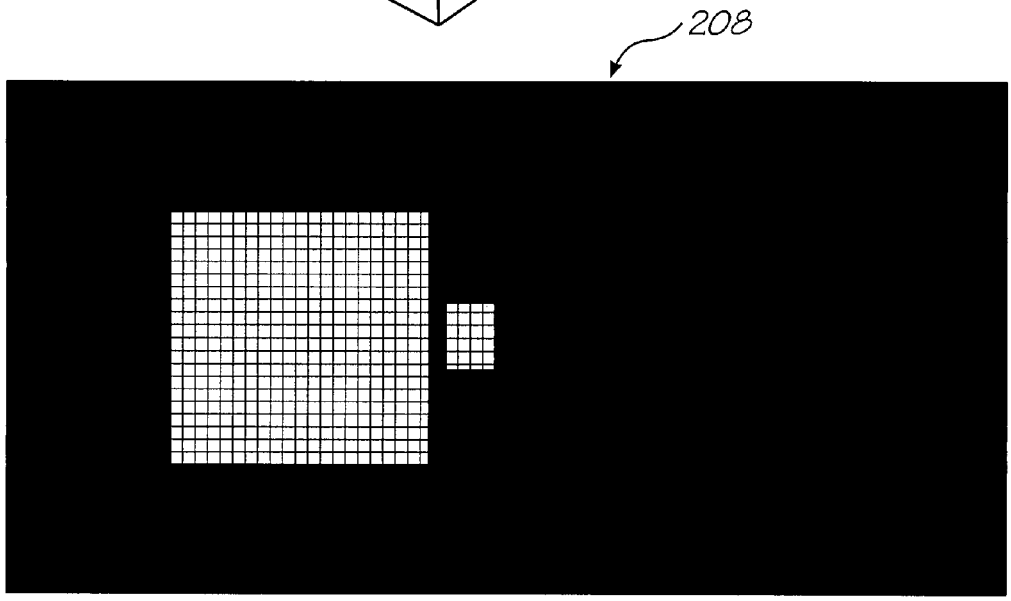
FIG. 20 illustrates a mask used for the deposition of the first sacrificial layer.

The layer 206 is developed using a mask 208, shown in FIG. 20.

Figure 22:
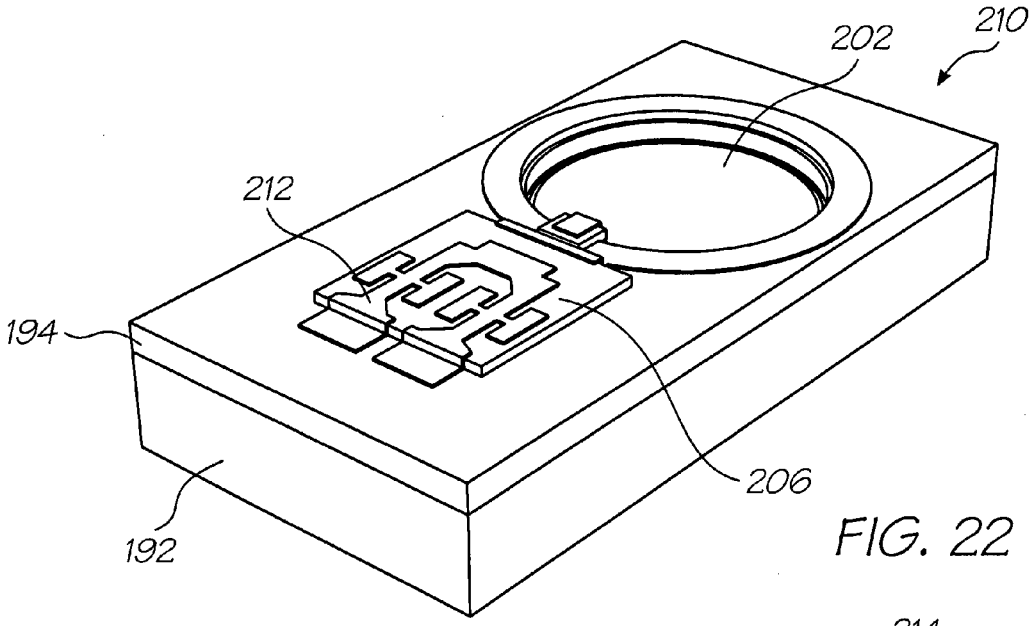
FIG. 22 is a perspective view of the wafer of FIG. 19 with a first layer of titanium nitride positioned on the first sacrificial layer.
Figure 24:
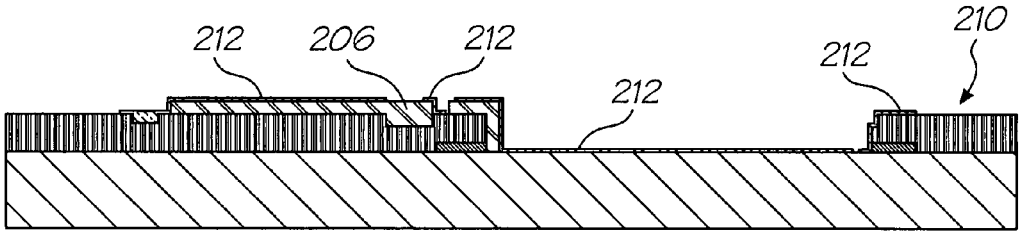
FIG. 24 is a side-sectioned view of the wafer of FIG. 22.

In FIGS. 22 and 24, reference numeral 210 generally indicates the structure 204 with a 0.2-micron thick layer of titanium nitride 212 deposited on the structure 204 and subsequently etched.

Figure 23:
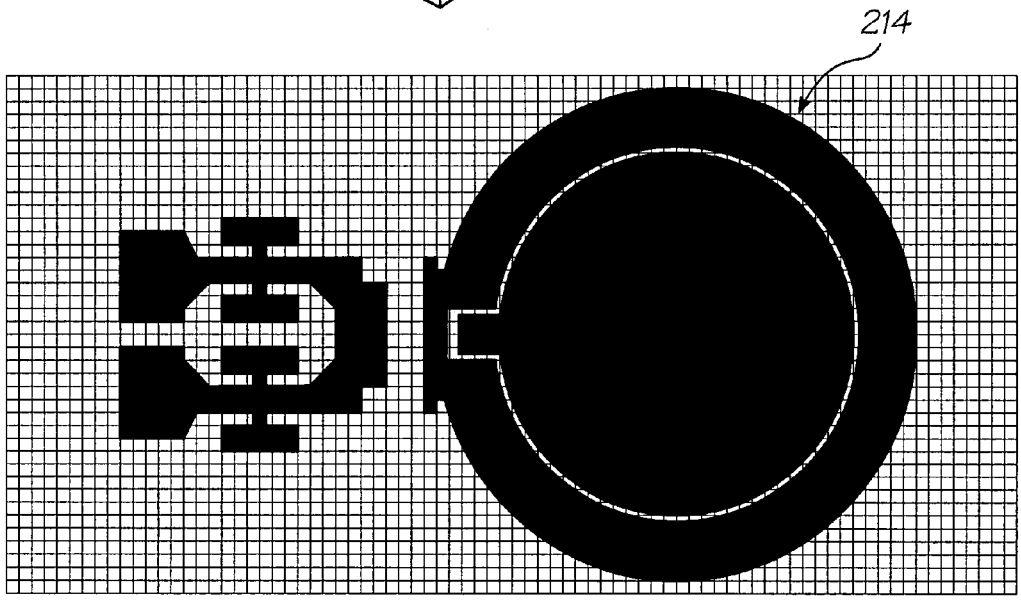
FIG. 23 illustrates a mask used for the deposition of the first titanium nitride layer.

The titanium nitride 212 is sputtered on the structure 204 using a magnetron. Then, the titanium nitride 212 is etched using a mask 214 shown in FIG. 23. The titanium nitride 212 defines the activating arm 140.1, the re-entrant formation 166 and the paddle 134. It will be appreciated that the polyimide 206 ensures that the activating arm 140.1 is positioned 1 micron above the silicon nitride layer 116.

Figure 25:
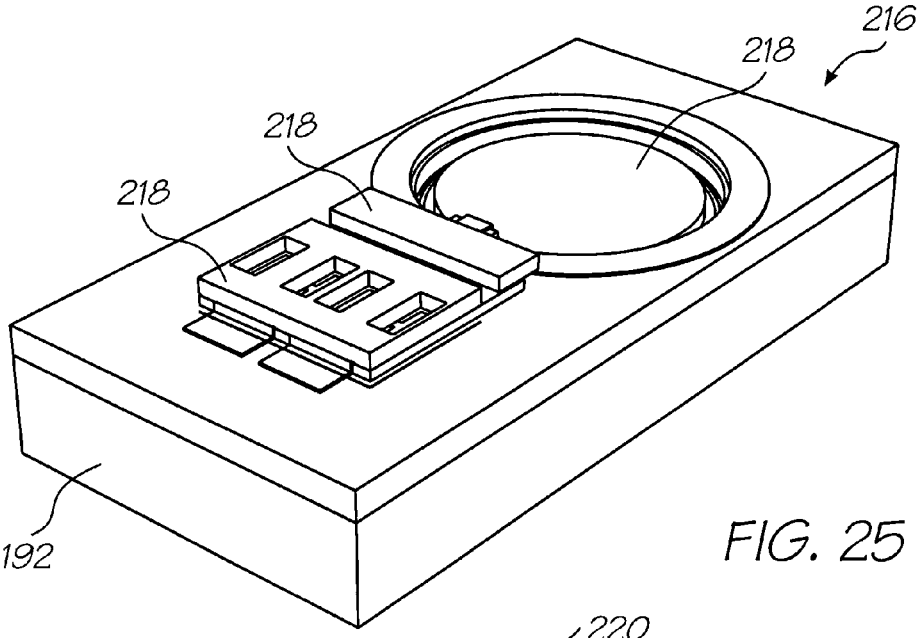
FIG. 25 is a perspective view of the wafer of FIG. 22 with a second sacrificial layer deposited on the first layer of titanium nitride.
Figure 27:
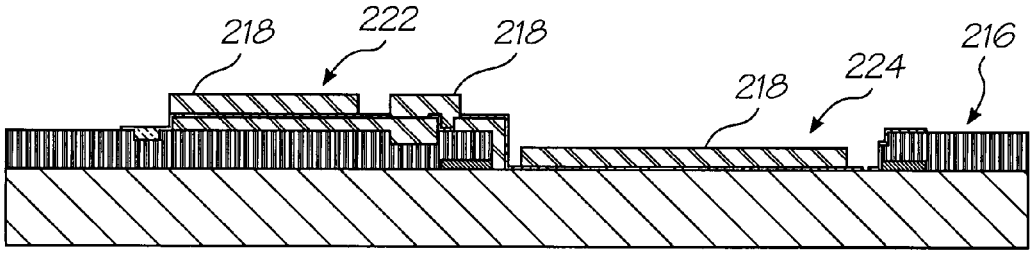
FIG. 27 is a sectioned side view of the wafer of FIG. 25.

In FIGS. 25 and 27, reference numeral 216 generally indicates the structure 210 with a 1.5-micron thick layer 218 of sacrificial photosensitive polyimide deposited on the structure 210.

Figure 26:
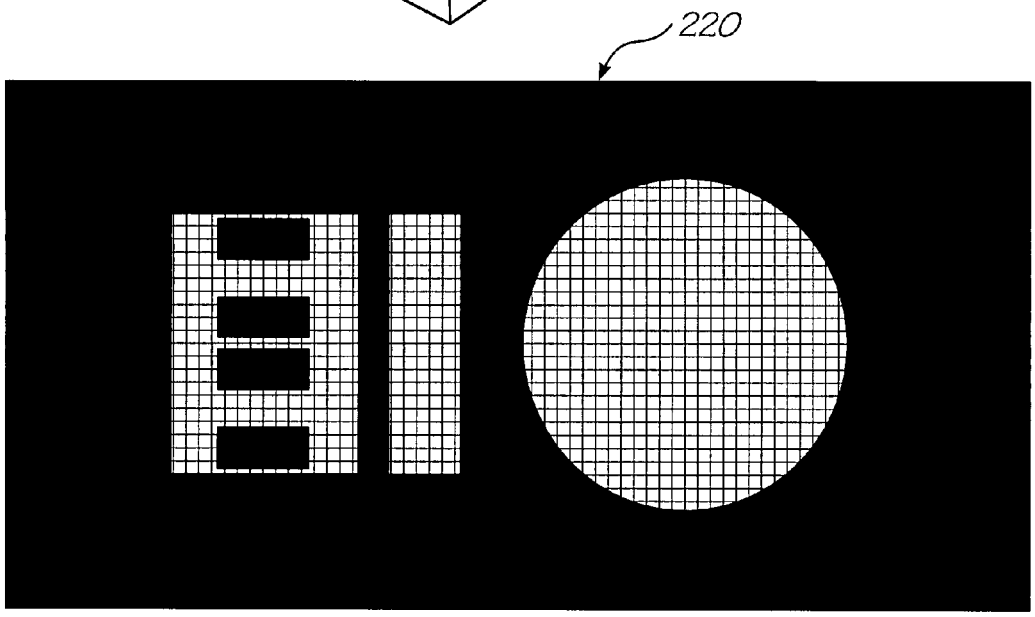
FIG. 26 illustrates a mask used for the deposition of the second sacrificial layer.

The polyimide 218 is developed with ultra-violet light using a mask 220 shown in FIG. 26.

The remaining polyimide 218 is used to define a deposition zone 222 for the activating arm 140.2 and a deposition zone 224 for the raised formation 172 on the paddle 134. Thus, it will be appreciated that the gap 142 has a thickness of 1.5 micron.

Figure 28:
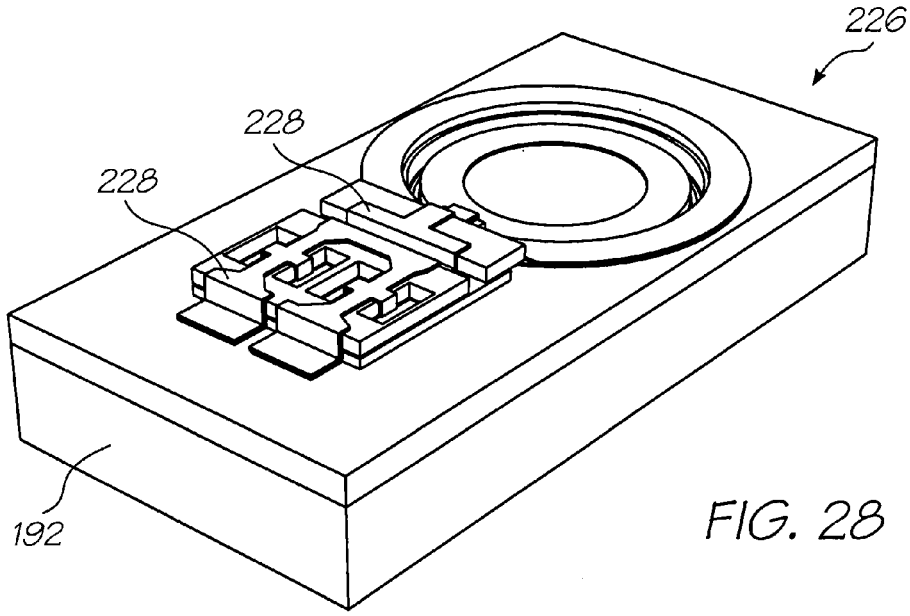
FIG. 28 is a perspective view of the wafer of FIG. 25 with a second layer of titanium nitride deposited on the second sacrificial layer.
Figure 30:
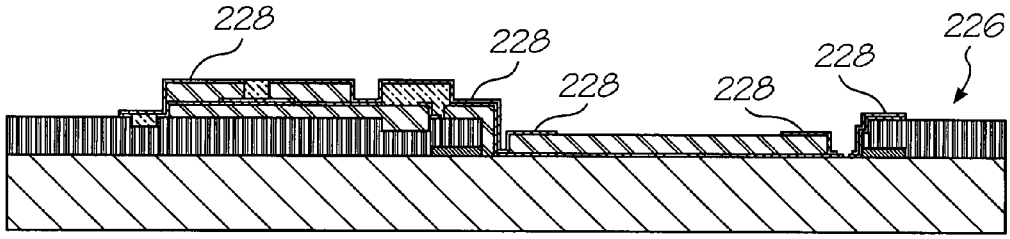
FIG. 30 illustrates a side-sectioned view of the wafer of FIG. 28.

In FIGS. 28 and 30, reference numeral 226 generally indicates the structure 216 with a 0.2-micron thick layer 228 of titanium nitride deposited on the structure 216.

Figure 29:
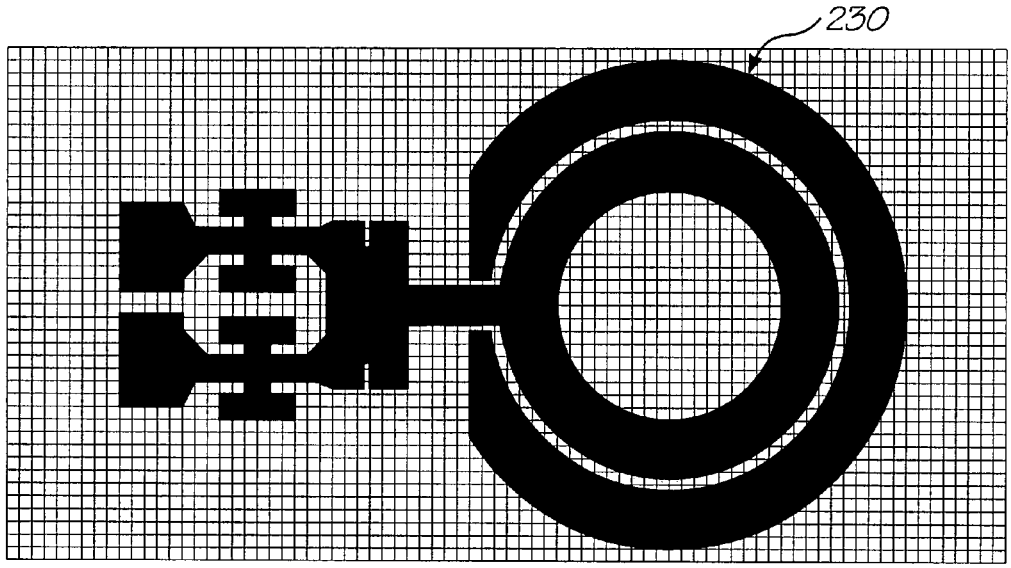
FIG. 29 illustrates a mask for the deposition of the second layer of titanium nitride.

Firstly, a 0.05-micron thick layer of PECVD silicon nitride (not shown) is deposited on the structure 216 at a temperature of 572 degrees Fahrenheit. Then, the layer 228 of titanium nitride is deposited on the PECVD silicon nitride. The titanium nitride 228 is etched using a mask 230 shown in FIG. 29.

The remaining titanium nitride 228 is then used as a mask to etch the PECVD silicon nitride.

The titanium nitride 228 serves to define the activating arm 140.2, the raised formation 172 on the paddle 134, and the heat sink members 146.

Figure 31:
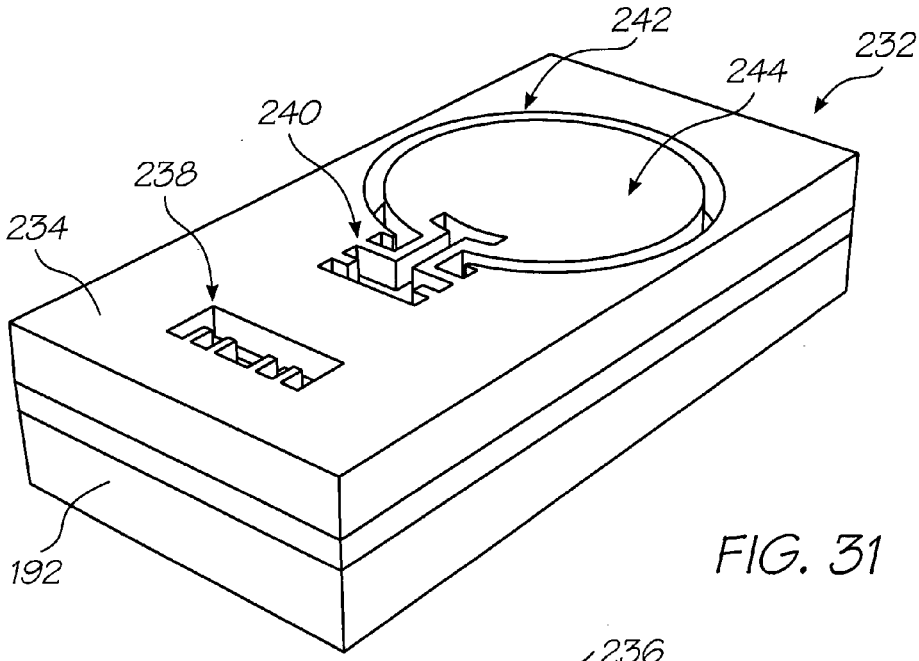
FIG. 31 is a perspective view of the wafer of FIG. 28 with a third layer of sacrificial material deposited on the second layer of titanium nitride.
Figure 33:
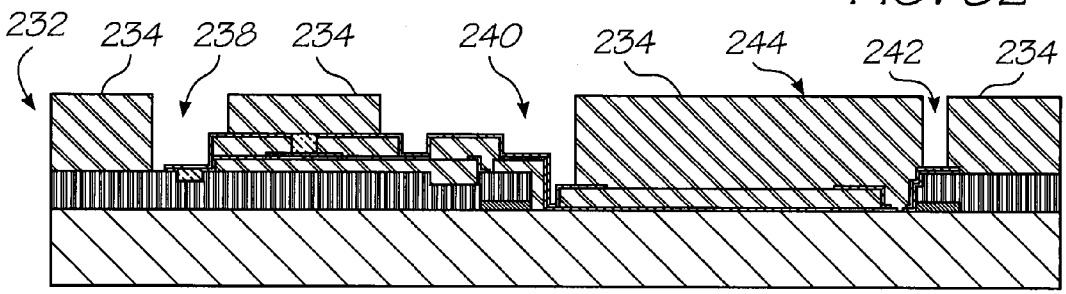
FIG. 33 is a side-sectioned view of the wafer of FIG. 31.

In FIGS. 31 and 33, reference numeral 232 generally indicates the structure 226 with 6 microns of photosensitive polyimide 234 deposited on the structure 226.

Figure 32:
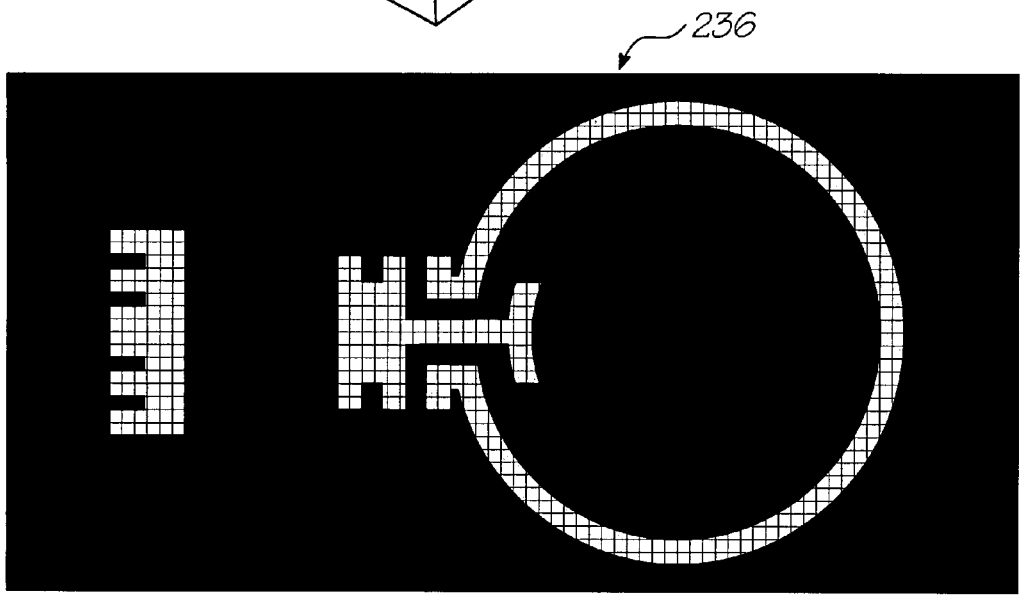
FIG. 32 illustrates a mask used for the deposition of the sacrificial material.

The polyimide 234 is spun on and exposed to ultra violet light using a mask 236 shown in FIG. 32. The polyimide 234 is then developed.

The polyimide 234 defines a deposition zone 238 for the anchoring member 128, a deposition zone 240 for the sealing structure 138, a deposition zone 242 for the nozzle chamber wall 118 and a deposition zone 244 for the roof wall 120.

It will be appreciated that the thickness of the polyimide determines the height of the nozzle chamber 122. A degree of taper of 1 micron from a bottom of the chamber to the top can be accommodated.

Figure 34:
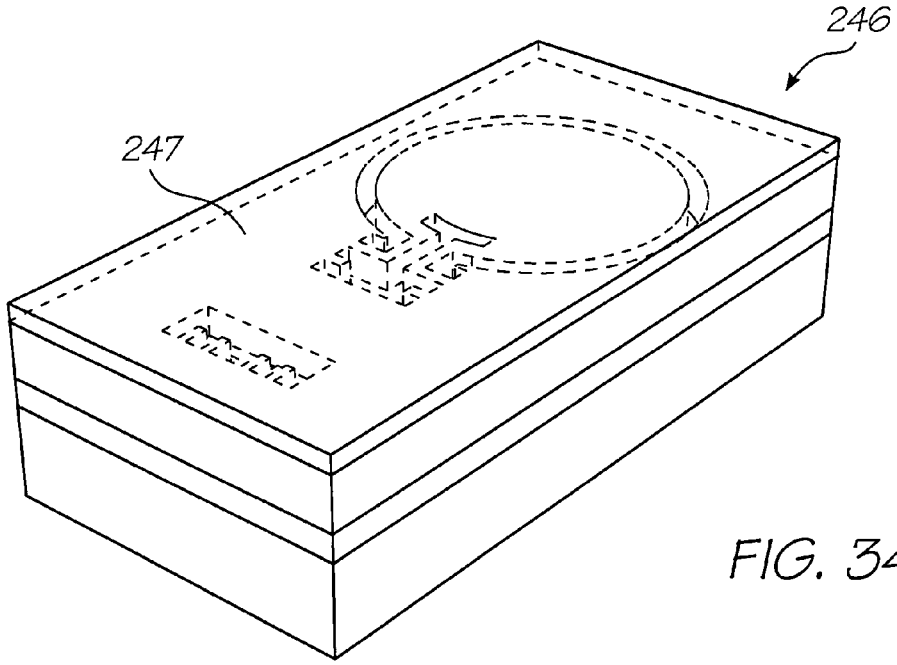
FIG. 34 is a perspective view of the wafer of FIG. 31 with a layer of structural material deposited on the third layer of sacrificial material.
Figure 36:
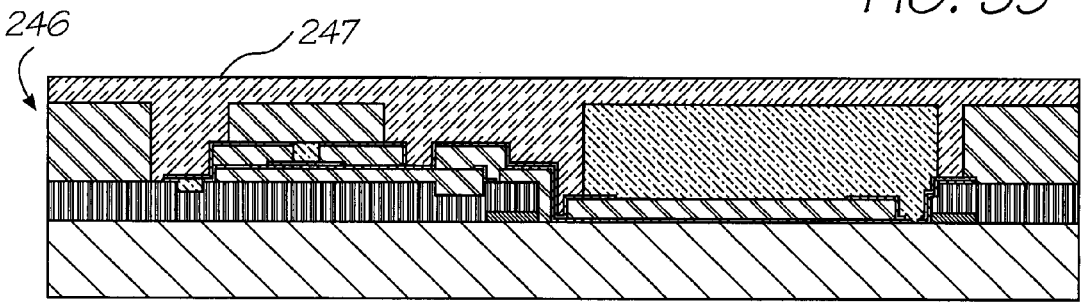
FIG. 36 is a side-sectioned view of the wafer of FIG. 34.

In FIGS. 34 and 36, reference numeral 246 generally indicates the structure 232 with 2 microns of PECVD silicon nitride 247 deposited on the structure 232.

Figure 35:
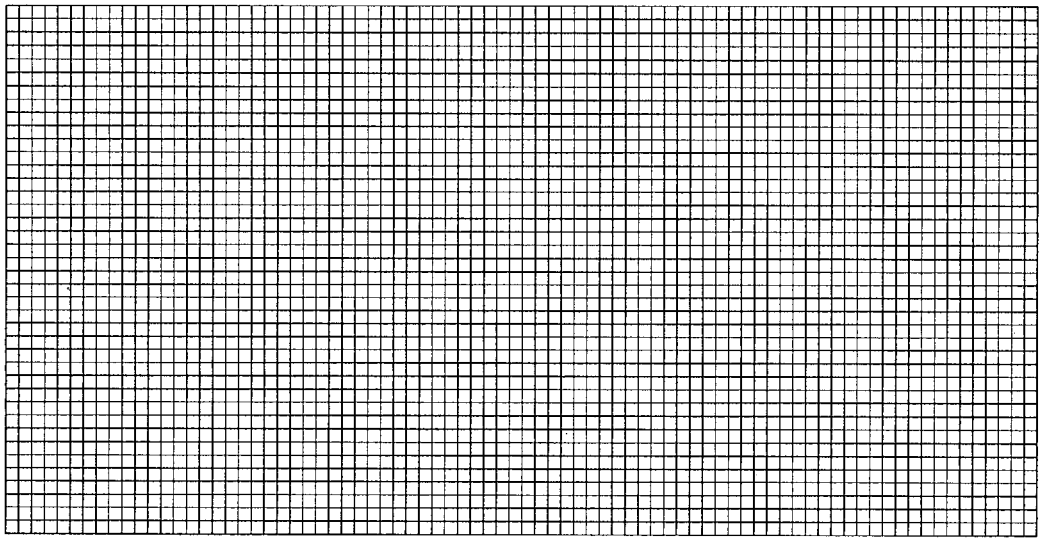
FIG. 35 illustrates that a mask is not used for the deposition of the structural material.

This serves to fill the deposition zones 238, 240, 242 and 244 with the PECVD silicon nitride. As can be seen in FIG. 35, no mask is used for this process.

Figure 37:
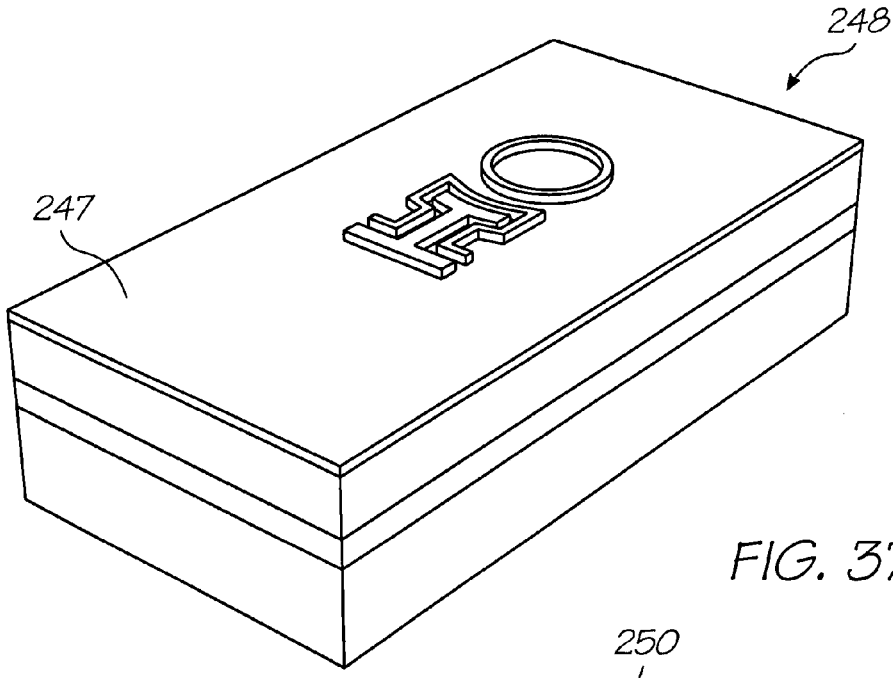
FIG. 37 is a perspective view of the wafer of FIG. 34 subsequent to an etching process carried out on the structural material.
Figure 39:
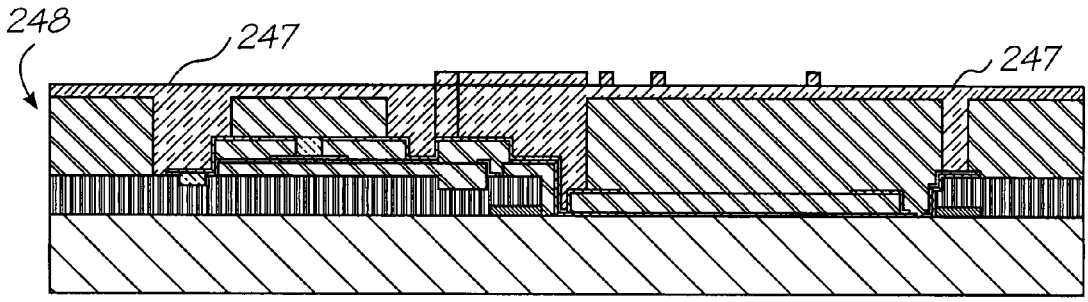
FIG. 39 is a side-sectioned view of the wafer of FIG. 37.

In FIGS. 37 and 39, reference numeral 248 generally indicates the PECVD silicon nitride 246 etched to define the nozzle rim 126, the ridge 162 and a portion of the sealing structure 138.

Figure 38:
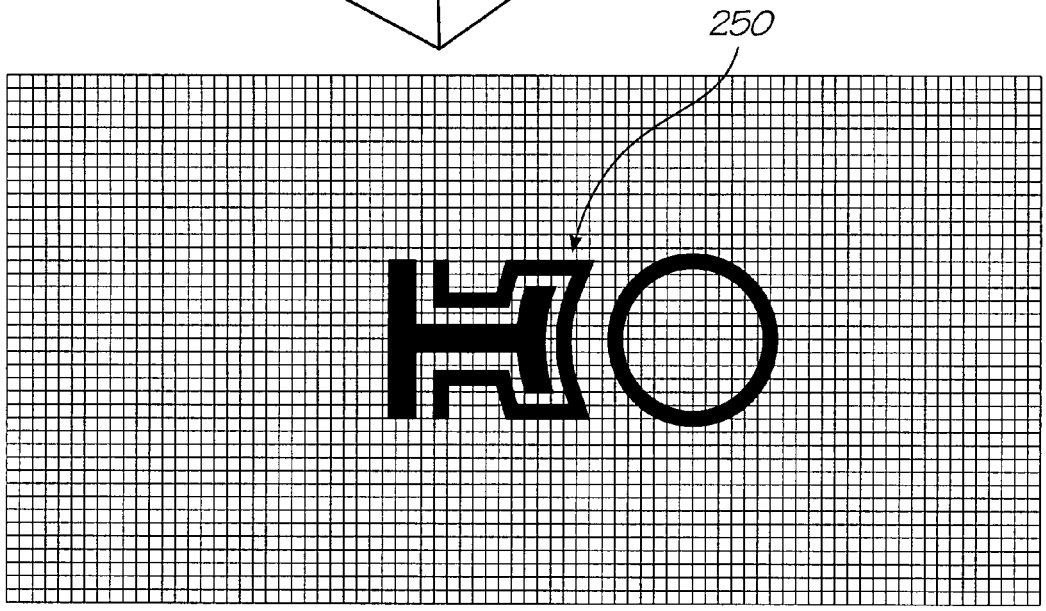
FIG. 38 illustrates a mask used for etching the structural material.

The PECVD silicon nitride 246 is etched using a mask 250 shown in FIG. 38.

Figure 40:
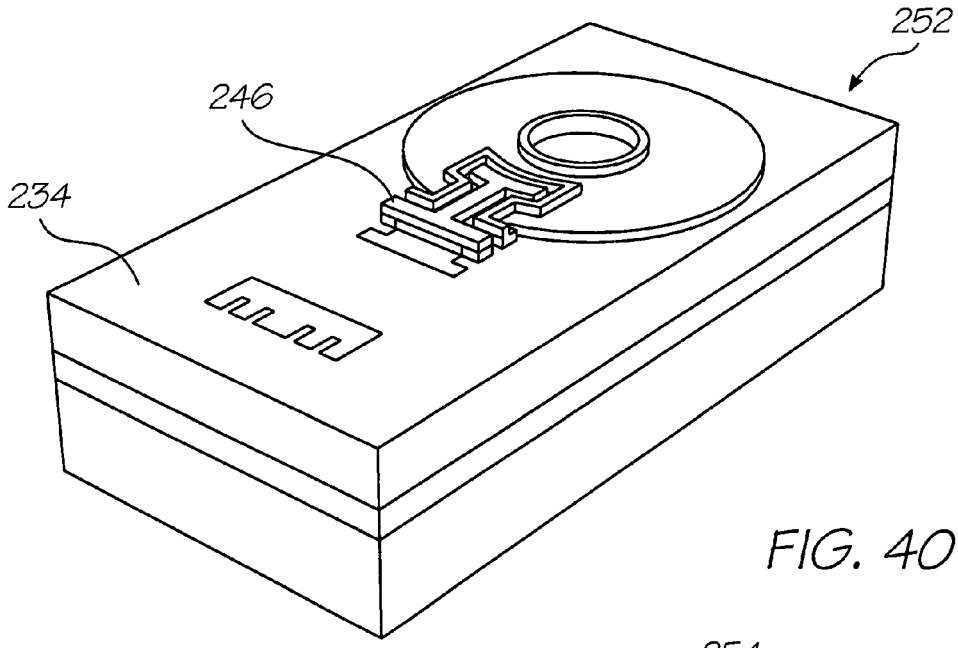
FIG. 40 is a perspective view of the wafer of FIG. 37 subsequent to a further etching process carried out on the structural material.
Figure 42:
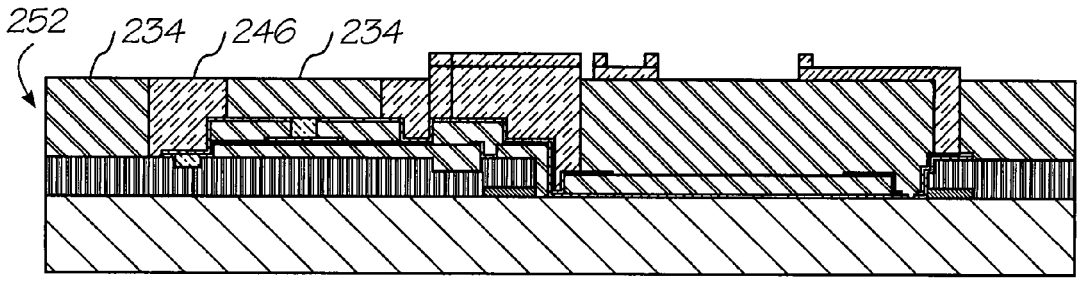
FIG. 42 is a side-sectioned view of the wafer of FIG. 40.

In FIGS. 40 and 42 reference numeral 252 generally indicates the structure 248 with the PECVD silicon nitride 246 etched to define a surface of the anchoring member 128, a further portion of the sealing structure 138 and the fluid ejection port 124.

Figure 41:
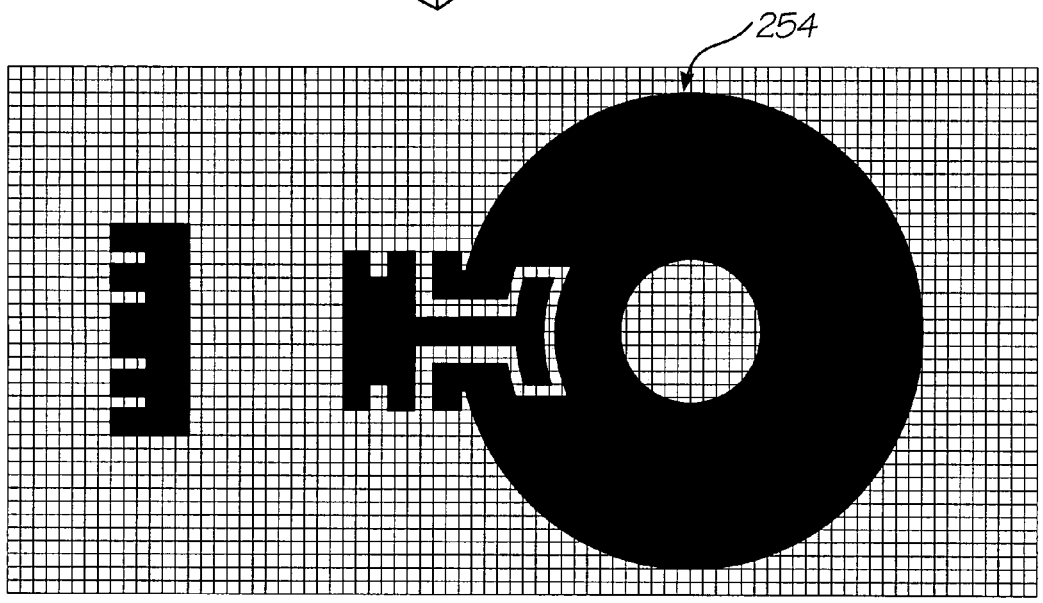
FIG. 41 illustrates a mask used for etching the structural material.

The etch is carried out using a mask 254 shown in FIG. 41 to a depth of 1 micron stopping on the polyimide 234.

Figure 43:
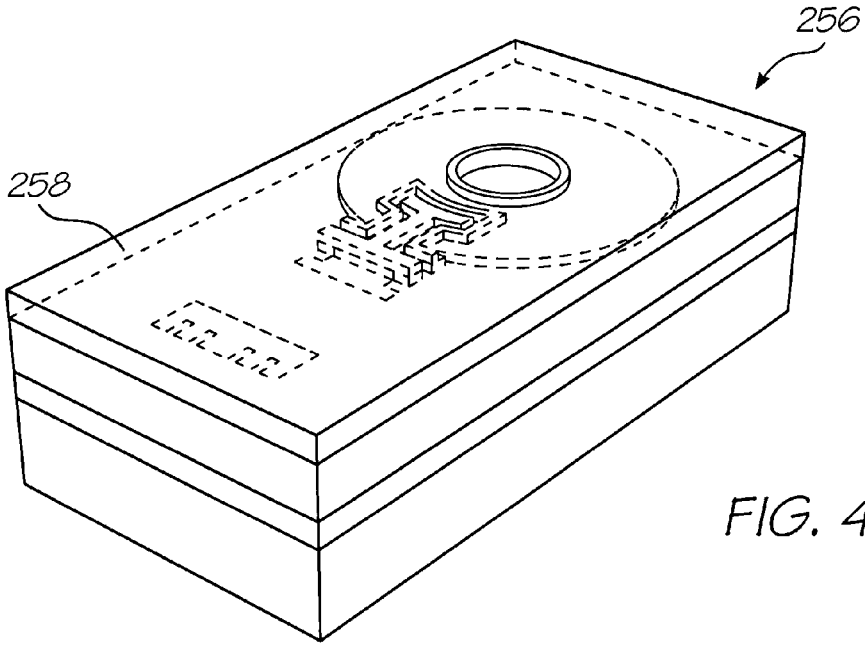
FIG. 43 is a perspective view of the wafer of FIG. 40 with a protective sacrificial layer deposited on the structural material.
Figure 45:
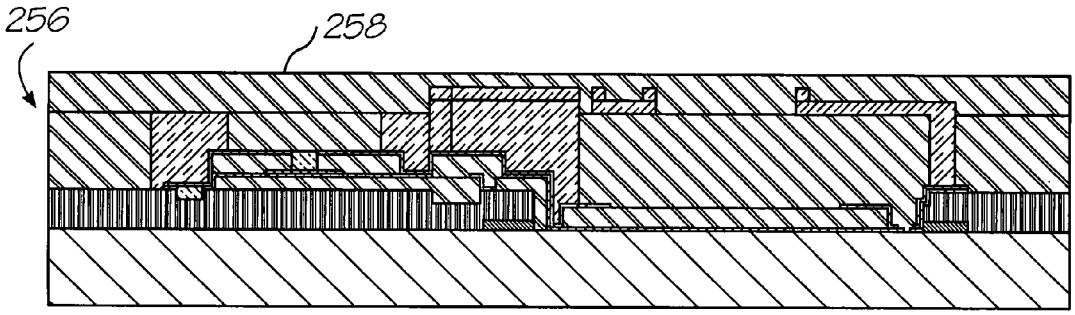
FIG. 45 is a side-sectioned view of the mask of FIG. 43.

In FIGS. 43 and 45, reference numeral 256 generally indicates the structure 252 with a protective layer 258 of polyimide spun on to the structure 252 as a protective layer for back etching the structure 256.

Figure 44:
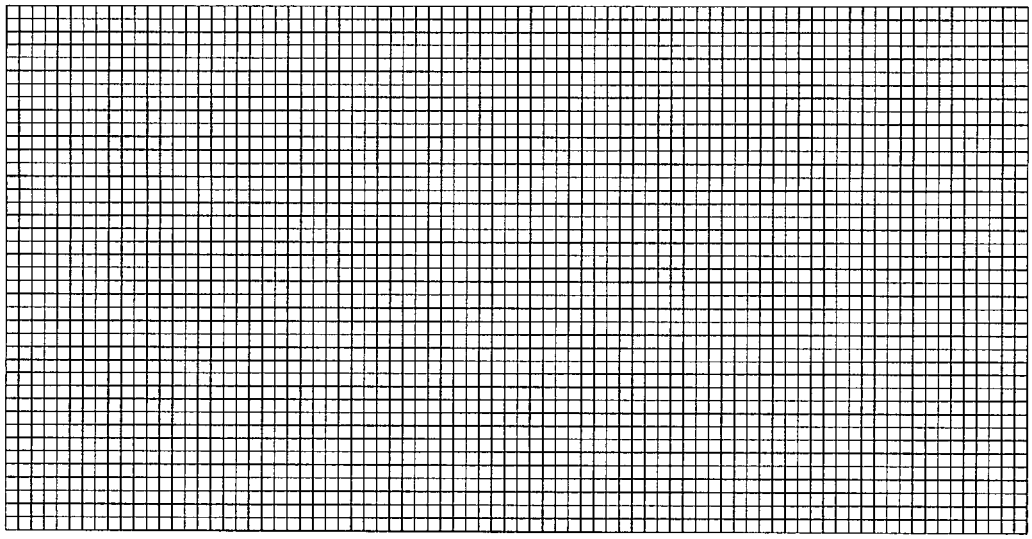
FIG. 44 indicates that a mask is not used for the deposition of the protective sacrificial layer.

As can be seen in FIG. 44, a mask is not used for this process.

Figure 46:
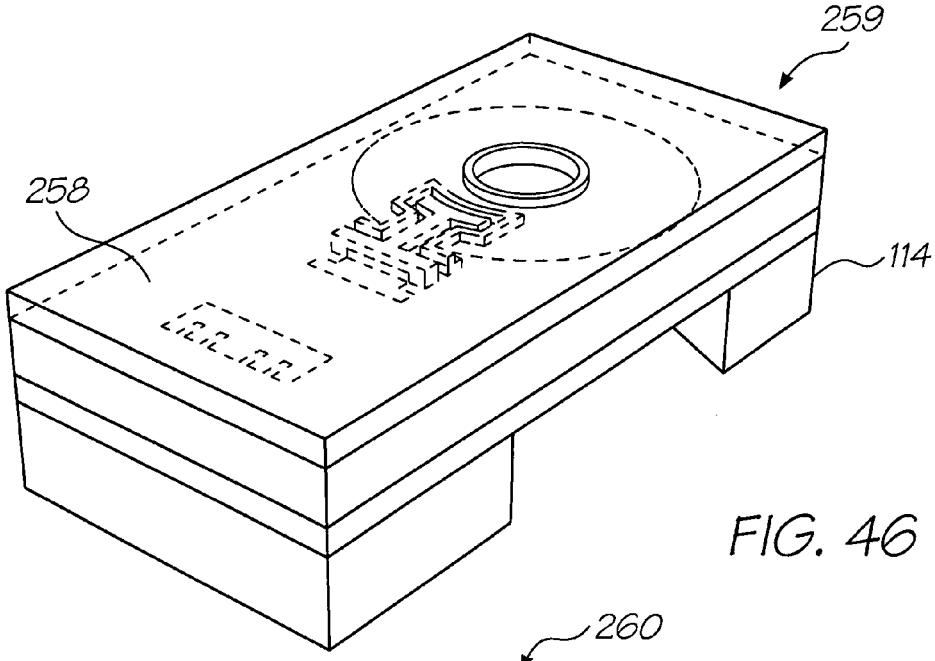
FIG. 46 is a perspective view of the wafer of FIG. 43 subsequent to a back etch being carried out on the wafer.
Figure 48:
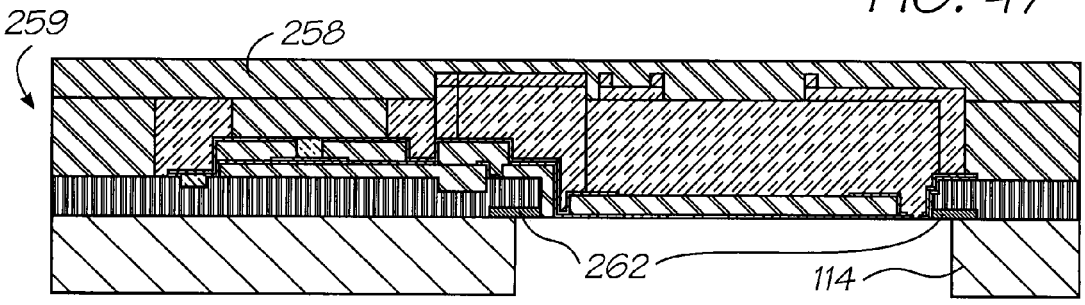
FIG. 48 is a side-sectioned view of the wafer of FIG. 46.

In FIGS. 46 and 48, reference numeral 259 generally indicates the structure 256 subjected to a back etch.

Figure 47:
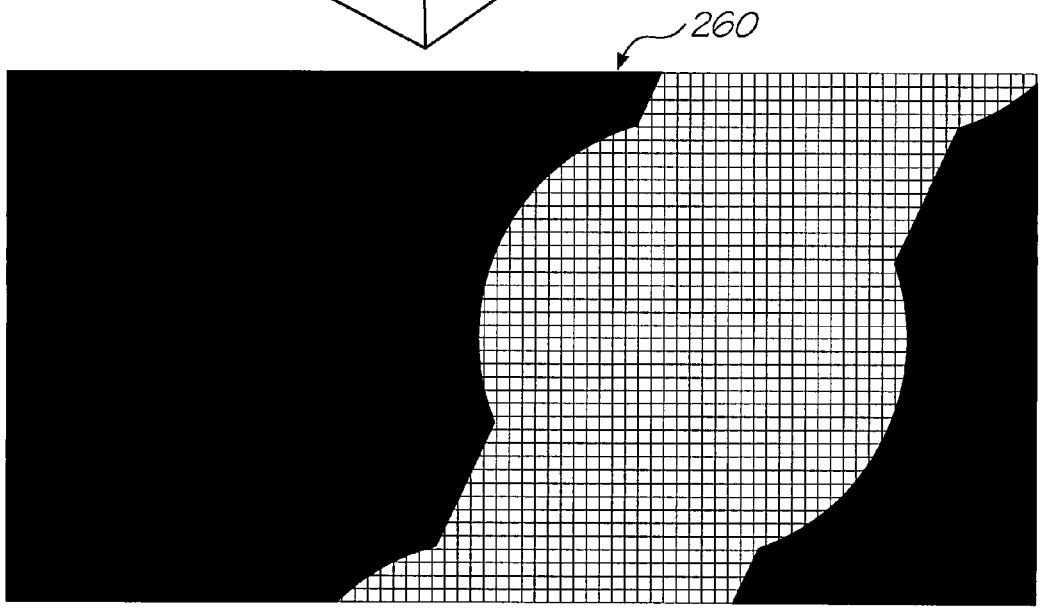
FIG. 47 illustrates a mask used for the back etch.

In this step, the wafer substrate 114 is thinned to a thickness of 300 microns. 3 microns of a resist material (not shown) are deposited on the back side of the wafer 114 and exposed using a mask 260 shown in FIG. 47. Alignment is to metal portions 262 on a front side of the wafer 114. This alignment is achieved using an IR microscope attached to a wafer aligner.

The back etching then takes place to a depth of 330 microns (allowing for a 10% overetch) using a deep-silicon "Bosch Process" etch. This process is available on plasma etchers from Alcatel, Plasma-therm, and Surface Technology Systems. The chips are also diced by this etch, but the wafer is still held together by 11 microns of the various polyimide layers. This etch serves to define the fluid inlet channel 121.

Figure 49:
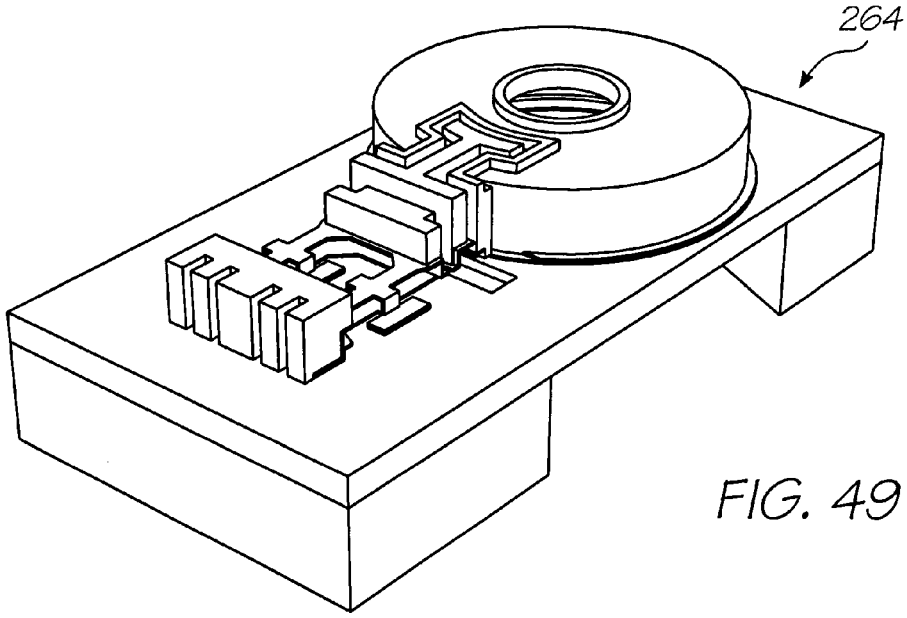
FIG. 49 is a perspective view of the wafer of FIG. 46 with all the sacrificial material stripped from the wafer of FIG. 46.
Figure 50:
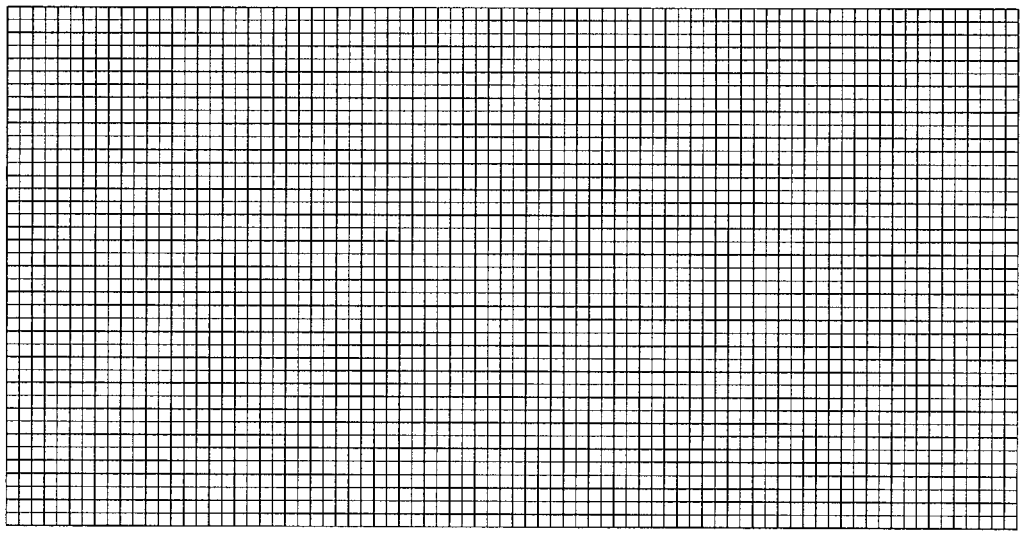
FIG. 50 indicates that a mask is not used for the stripping of the sacrificial material.
Figure 51:
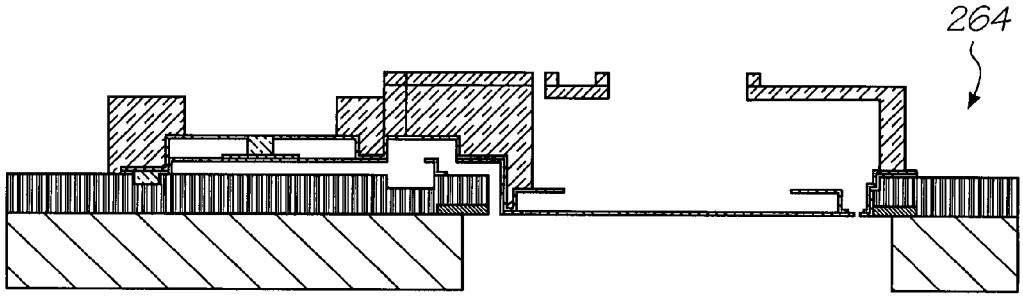
FIG. 51 is a side-sectioned view of the wafer of FIG. 49.

In FIGS. 49 and 51, reference numeral 264 generally indicates the structure 259 with all the sacrificial material stripped. This is done in an oxygen plasma etching process. As can be seen in FIG. 50, a mask is not used for this process.

Figure 52:
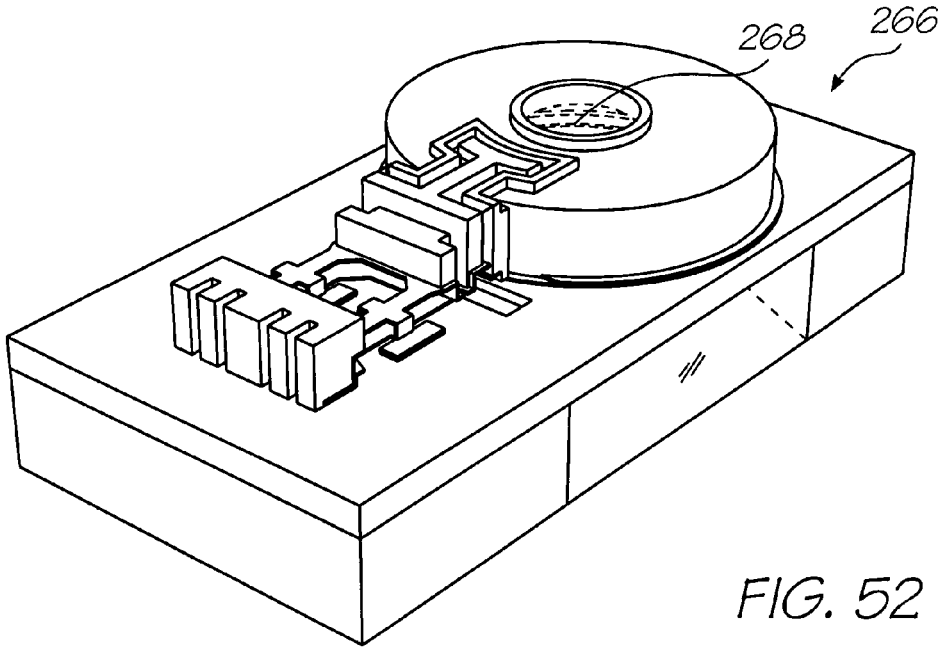
FIG. 52 is a perspective view of the nozzle arrangement filled with fluid for testing purposes.
Figure 53:
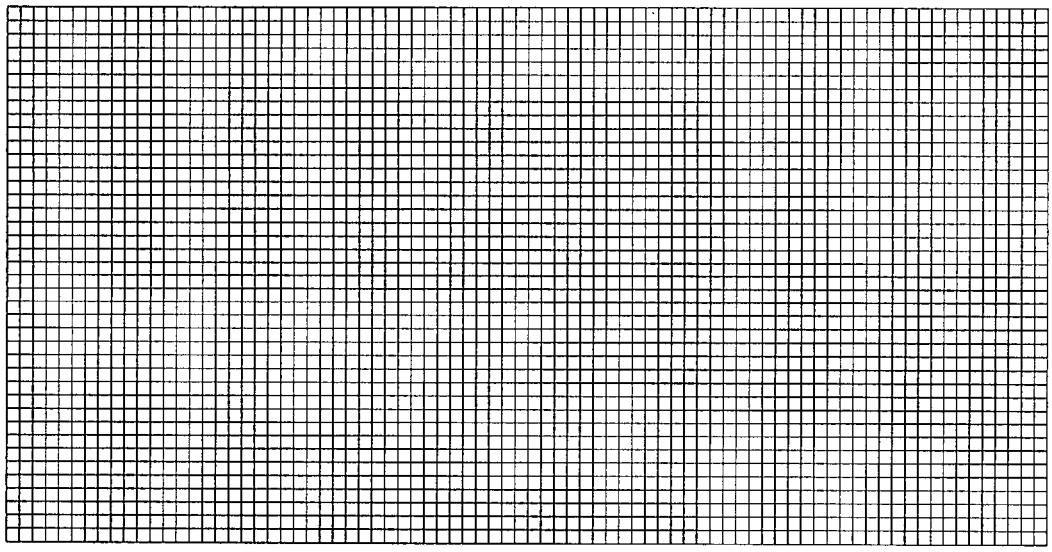
FIG. 53 indicates that a mask is not used.
Figure 54:
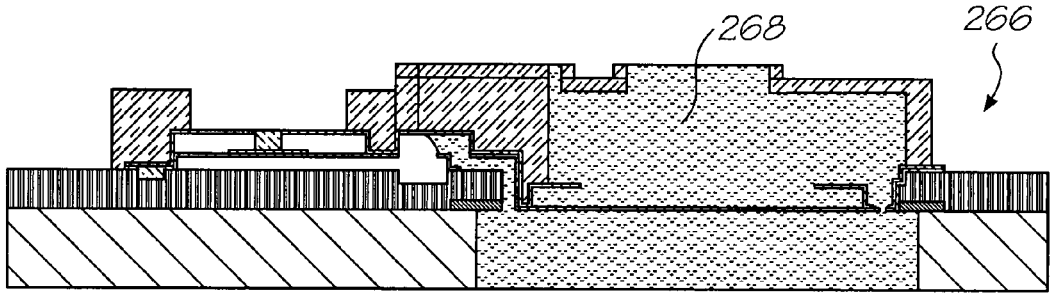
FIG. 54 is a side-sectioned view of the nozzle arrangement of FIG. 52.
Figure 55:
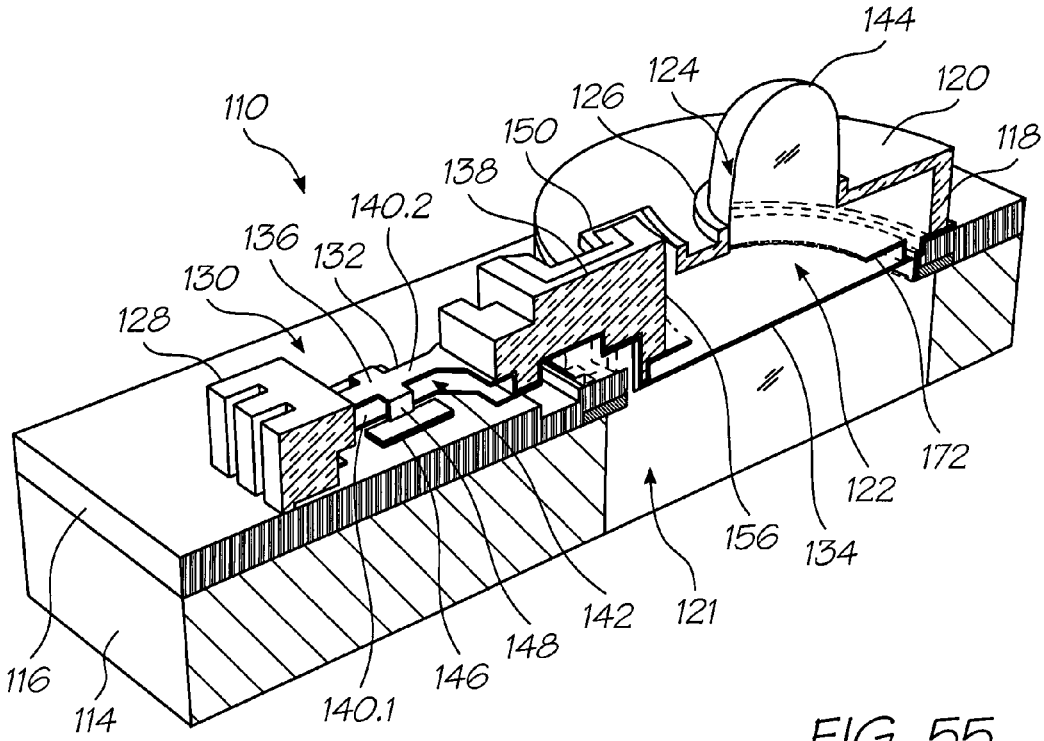
FIG. 55 is a side-sectioned perspective view of the nozzle arrangement in a firing condition.
Figure 56:
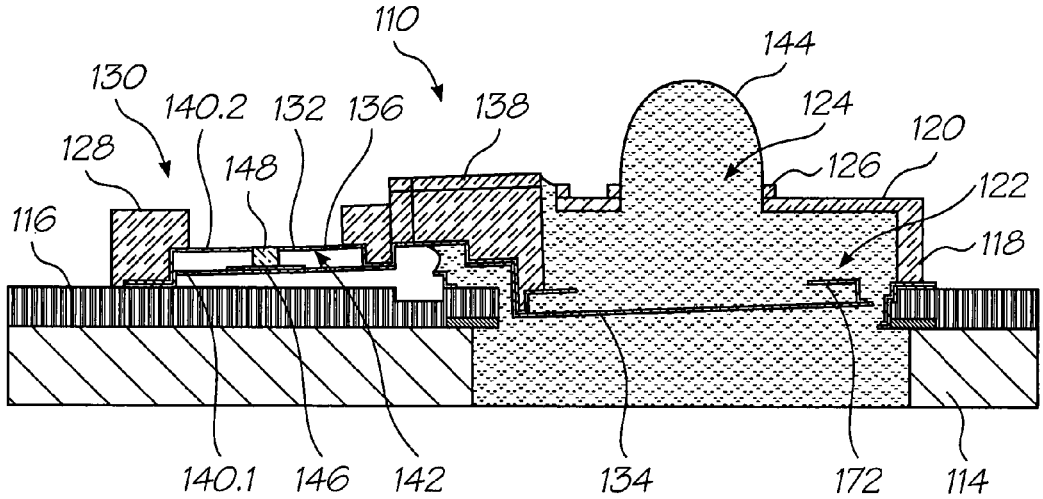
FIG. 56 is a side-sectioned view of the nozzle arrangement of FIG. 55.

In FIGS. 52 and 54, reference numeral 266 generally indicates the structure 264, which is primed with fluid 268. In particular, a package is prepared by drilling a 0.5 mm hole in a standard package, and gluing a fluid hose (not shown) to the package. The fluid hose should include a 0.5-micron absolute filter to prevent contamination of the nozzles from the fluid 268.

The integrated circuit device of the invention is potentially suited to a wide range of printing systems including: colour and monochrome office printers, short run digital printers, high speed digital printers, offset press supplemental printers, low cost scanning printers, high speed pagewidth printers, notebook computers with in-built pagewidth printers, portable colour and monochrome printers, colour and monochrome copiers, colour and monochrome facsimile machines, combined printer, facsimile and copying machines, label printers, large format plotters, photograph copiers, printers for digital photographic 'minilabs', video printers, PHOTOCD™ printers, portable printers for PDAs, wallpaper printers, indoor sign printers, billboard printers, fabric printers, camera printers and fault tolerant commercial printer arrays.

Further, the MEMS fabrication principles outlined have general applicability in the construction of MEMS devices.

It would be appreciated by a person skilled in the art that numerous variations and/or modifications may be made to the present invention as shown in the preferred embodiment without departing from the spirit or scope of the invention as broadly described. The preferred embodiment is, therefore, to be considered in all respects to be illustrative and not restrictive.

I claim:

1. A printhead for an inkjet printer, the printhead comprising:

a wafer substrate assembly defining spaced apart groups of ink inlet channels; and groups of ink ejection nozzle arrangements extending from the wafer substrate assembly and in fluid communication with respective ink inlet channel groups, each group of ink ejection nozzle arrangements including a two dimensional array of ink ejection nozzle arrangements arranged in rows and ranks so that the rows and ranks are obliquely aligned with respect to each other.

2. A printhead for an inkjet printer as claimed in claim 1, wherein an angle of about 60° is formed between the rows and ranks.

3. A printhead for an inkjet printer as claimed in claim 1, further including a plurality of ink spread prevention formations located between respective adjacent pairs of groups of ink ejection nozzle arrangements.

4. A printhead for an inkjet printer as claimed in claim 1, wherein each ink ejection nozzle arrangement comprises:

a nozzle chamber structure mounted to the wafer substrate assembly and defining a nozzle chamber for receiving ink from an ink inlet channel and an ejection port through which ink in the nozzle chamber can be ejected; and an elongate thermal actuator extending from the wafer substrate assembly and into the nozzle chamber, the thermal actuator comprising an actuating arm terminating in a free end within the nozzle chamber and a pair of spaced actuating members located outside the nozzle chamber, one of the actuating members being connected to a current supply so that, in use, the free end of the arm can be moved to eject ink in the nozzle chamber through the ejection port as a result of differential thermal expansion.

5. A printhead for an inkjet printer as claimed in claim 4, wherein the thermal actuators in each group are aligned to be parallel to each other.

6. A printhead for an inkjet printer as claimed in claim 5, wherein the thermal actuators in each group extend into their corresponding nozzle chamber structures in the same direction.

7. A printhead for an inkjet printer as claimed in claim 4, wherein the free end of the actuating arm terminates in a paddle and the nozzle chamber structure defines a raised external rim bounding the ejection port.

* * * * *